US006021730A

United States Patent [19]

Carey, II

[11] Patent Number: 6,021,730

[45] Date of Patent: Feb. 8, 2000

[54] FLOAT DRUM

[75] Inventor: Jay F. Carey, II, Follansbee, W. Va.

[73] Assignee: The Louis Berkman Company, Steubenville, Ohio

[21] Appl. No.: 09/183,318

[22] Filed: Oct. 30, 1998

[51] Int. Cl.[7] ..... B63B 35/44

[52] U.S. Cl. ..... 114/263; 114/267

[58] Field of Search ..... 114/267, 263, 114/266, 264; 441/1, 129, 130, 131, 133; 405/219

[56] References Cited

U.S. PATENT DOCUMENTS

| | | | |
|---|---|---|---|
| 2,866,985 | 1/1959 | Blackmore . | |
| 3,242,245 | 3/1966 | Greig . | |
| 3,250,660 | 5/1966 | Greig . | |
| 3,412,183 | 11/1968 | Anderson . | |
| 3,446,172 | 5/1969 | Morton et al. . | |
| 3,599,257 | 8/1971 | Erickson . | |
| 3,752,102 | 8/1973 | Shuman . | |
| 3,921,238 | 11/1975 | Johnson | 114/267 |
| 4,161,796 | 7/1979 | Kostanecki . | |
| 4,365,577 | 12/1982 | Heinrich . | |
| 4,799,445 | 1/1989 | Meriwether . | |
| 4,803,943 | 2/1989 | Corbett . | |
| 4,940,021 | 7/1990 | Rytand . | |
| 4,974,538 | 12/1990 | Meriwether . | |
| 4,979,453 | 12/1990 | Sloan . | |
| 5,117,775 | 6/1992 | Northam et al. | 114/267 |
| 5,775,248 | 7/1998 | Simola . | |
| 5,799,916 | 9/1998 | Lechner | 114/267 |

*Primary Examiner*—Stephen Avila
*Attorney, Agent, or Firm*—Vickers, Daniels & Young

[57] ABSTRACT

An improved float drum for marine structures which includes a controllable buoyancy device in the interior of the float drum to control the buoyancy of the float drum. The float drum can include a valve to control the type and/or amount of fluid in the interior of the float drum, and/or to check the integrity of the float drum. The float drum can include a stabilizer to dampen the movement of the float drum in a liquid medium. The float drum is made of a corrosion-resistant, puncture resistant material to enhance the like of the float drum.

103 Claims, 9 Drawing Sheets

FLOAT DRUM

This invention relates generally to float drums and more particularly to float drums which are filled with a buoyancy control material and/or device. The invention is particularly applicable to float drums for use with floating docks, floating pipe lines, swim floats and the like and will be described with particular reference thereto. However, it will be appreciated that the invention may have broader application and may be used to provide buoyancy to any structure desired to be floated in a liquid medium.

INCORPORATION BY REFERENCE

The following documents are incorporated herein by reference: Simola U.S. Pat. No. 5,775,248; Sloan U.S. Pat. No. 4,979,453; Meriwether U.S. Pat. No. 4,974,538; Meriwether U.S. Pat. No. 4,799,445; Heinrich U.S. Pat. No. 4,365,577; Shuman U.S. Pat. No. 3,752,102; Anderson U.S. Pat. No. 3,412,183; Greig U.S. Pat. No. 3,250,660; Greig U.S. Pat. No. 3,242,245; and U.S. patent application Ser. No. 09/092,882 filed Jun. 8, 1998.

BACKGROUND OF THE INVENTION

Float drums have evolved from crude sealed metal drum and blocks of Styrofoam into hollow polyethylene shells which are precisely configured and designed to fit especially within intricate dock structures typically sold in kit form. An example of an early design of a hollow polyethylene float is disclosed in the Shuman U.S. Pat. No. 3,752,102 and marketed under the "Dayton" brand name. Sloan U.S. Pat. No. 4,979,453 discloses the use of metal drums supporting a dock system. Meriwether U.S. Pat. No. 4,974,538 and Meriwether U.S. Pat. No. 4,799,445 describe the current, state of the art polyethylene float and the integration of the float within sophisticated floating marine structures. Specifically, today's floats are constructed with rigidized circumscribing flanges for secure mounting to the dock structure; ribs secured to the underside of the flange for strengthening the side walls and the flange and spaced indentations horizontally positioned on the float which also strengthen the float walls while providing indentations for receiving dock structure members or, alternatively, for interlocking the float drums one on top of the other or side-by-side.

Polyethylene float drums are typically formed as hollow shells in a process generally described in the trade as "twin sheet forming." The process is generally described in the process patents incorporated by reference herein. The floats are then marketed either as hollow, air filled floats or the floats are filled with a flotation material. In the latter instance, a hole is provided in the drum and a urethane foam is injected into the float, expanded and cured. As noted in Heinrich U.S. Pat. No. 4,365,577, the urethane is usually introduced into the float while the float is still confined to prevent bulging. When the urethane is cured, the filled float provides a somewhat rigid foam reinforcement for polyethylene walls thus adding strength to the float while also preventing leakage of water into the float if the polyethylene walls are accidentally or maliciously punctured. Meriwether U.S. Pat. No. 4,974,538 discloses a polyethylene float drum for supporting marine structures which includes top and bottom flanges that are integrally sealed together and a solid, core of preformed flotation material which substantially fills the entire volume of the configured enclosure so that the polyethylene float is positively assured of having rigidized wall surfaces. The preformed material used is preferably polystyrene.

Although the float drum technology has significantly developed, there exists several problems with using polyethylene float drums. Polyethylene float drums are susceptible to being punctured or ruptured is harsh environments. Dock systems which are adjacent to an ocean or large lake can be subjected to very turbulent conditions. These turbulent conditions can cause frequent and significant dock movement that can result in damage to the polyethylene float drums. The damage to the float drum allows water to enter the float drum which compromises the buoyancy of the float drum and can damage the foam in the float drum.

Another problem with existing float drums is that it is difficult to adjust the buoyancy of a float for use in various applications. Prefabricated floats have a set buoyancy thus cannot be used in various applications or dock system designs.

Still another problem with existing float drums is the difficulty in checking the integrity of the drum when attached to a dock system. When the float drums are secured to a dock system, it is difficult, if not impossible to check if the float has been damaged or has become structurally compromised. Consequently, float drums are typically not replaced until long after the float drum has cracked or ruptured.

Yet another problem with existing float drums is the inability to control the pressure within the float drum. The pressure in the float drum is a function of the temperature of the float drum. In summer months, the float drum is exposed to higher temperatures, and in winter months, the float drum is exposed to lower temperatures. The temperature of the float directly affects the pressure within the float drum. Higher temperatures cause the gasses in the float drum to expand and lower temperatures cause the gasses to contract. This expansion and contraction of gasses can cause the interior of the float drum to become over pressurized or form a vacuum. Over pressurization can cause warping or buckling of the float drum. A vacuum in the float drum can cause warping, buckling and promote leakage of the float drum.

Another problem with existing float drums is the undesired growth within the float drums. Over time, algae, moss, microbes, etc. grow and live in the interior of the float drum. These organisms can cause damage to the float drum, damage to the interior components of the float drum, create unwanted odors, and create other unsanitary conditions.

In view of the state of the art of float drums, there is a need for a float drum which can be used in a variety of environments, can have its buoyancy adjusted and can have the integrity of the float easily and conveniently checked.

SUMMARY OF THE INVENTION

The invention pertains to an improved float drum that is environmentally friendly, very versatile and highly durable in a variety of environments.

Accordingly, the invention pertains to a corrosion resistant, puncture resistant float drum having an adjustable buoyancy. The material selected for the float drum preferably resists being punctured when struck by blunt or sharp objects. The material is also preferably selected to resist cracking or rupturing when subjected to large and/or frequent amounts of stress. Preferably, the float drum is made of a corrosion resistant material. Such corrosion resistant materials include, but are not limited to, plastics, stainless steel, titanium, and metals coated with a corrosion resistant alloy. The float drum is designed to support marine structures, such as dock decks. In one preferred embodiment, the float drum includes a configured top wall portion terminating in a circumscribing top flange and a configured hollow bottom wall portion terminating in a circumscribing bottom flange. The top and bottom flanges are integrally sealed together so that the top and bottom portions define an enclosure having a predetermined configuration. The interior of the float drum is hollow and is defined by the interior surfaces of the top and bottom float portions. In still another preferred embodiment, the float drum can be blow molten to form a single piece unit. In another preferred embodiment, the float drum includes a configured hollow top wall portion terminating in a circumscribing top flange and a configured hollow bottom wall portion terminating in a circumscribing bottom flange. The top and bottom flanges are integrally sealed together so that the top and bottom portions define an enclosure having a predetermined configuration. In another preferred embodiment, the float drum is made substantially of stainless steel. In still another preferred embodiment, the float drum is a plastic float drum made of a plastic material, such as polyethylene. In a further preferred embodiment, the top and bottom flanges of the float drum are connected together by a weld, fusing the flanges together, an adhesive, bolt, rivets, screws, clamps, or the like.

In accordance with another feature of the present invention, the interior of the float drum includes a buoyancy control device to regulate or control the buoyancy of the float drum. The buoyancy control device can be used to set a minimum buoyancy of the float drum. In addition or in the alternative, the buoyancy control device can be used to regulate and/or alter the buoyancy of the float drum. In one preferred embodiment, the buoyancy control device is environmentally friendly. In another preferred embodiment, the buoyancy control device is in fluid communication with one or more openings in the float drum. In yet another preferred embodiment, the interior of the float drum includes a plurality of compartments wherein one or more buoyancy control devices are positioned. In a further preferred embodiment, the buoyancy control device sets a minimum buoyancy which prevents the float drum from sinking in a liquid if the integrity of the float drum is compromised.

In accordance with still another feature of the present invention, the buoyancy control device includes a floatation material that partially or completely fills the interior of the float drum. The flotation material is designed to create a positive buoyancy of the float drum. The floatation material can also or alternatively function to reenforce the wall surfaces of the float drum. The floatation material is preferably polystyrene; however, other buoyant floatation materials such as polyurethane can be used. The flotation material can be used in plastic or metal float drums to control the buoyancy of the float drum. In one preferred embodiment, the external portions of the floatation conform at least nearly exactly to the internal dimensions of the top and bottom portions of the float drum. In another preferred embodiment, the flotation material only fills a portion of the interior of the float drum and is maintained in a particular position within the float drum. In still another preferred embodiment, the floatation material is positioned in one or more compartments in the interior of the float drum. In yet another preferred embodiment, the floatation material is polystyrene and/or polyurethane, or other substantially closed cell foam. The floatation material can be preformed prior to insertion into the float drum and/or blown or poured into the interior of the float drum and then heated to cure the flotation material.

In accordance with yet another feature of the present invention, the buoyancy control device includes an inflatable material that partially or completely fills the interior of the float drum. The inflatable material can be used to a positive buoyancy of the float drum. Alternatively or addition, the inflatable material can be used to control the buoyancy of the float drum. The inflatable material is preferably a rubber material, plastic material or the like that can be partially or totally be inflated by one or more fluids. The inflatable material can be used in both plastic and metal float drums to control the buoyancy of the float drum. The inflatable material can be used in conjunction with or as an alternative to a floatation material to control the buoyancy of the float drum. The inflatable material may or may not be in fluid communication with the exterior of the float drum. In one preferred embodiment, the inflatable material is at least partially maintained in a particular position within the float drum. In another preferred embodiment, the inflatable material is partially or completely filled with a liquid to controllably reduce the buoyancy of the float drum. In yet another preferred embodiment, the inflatable material is partially filled with a liquid to controllably reduce the buoyancy of the float drum and partially filled with a gas to maintain a minimum buoyancy of the float drum. In a further preferred embodiment, the float drum includes a floatation material to at least partially ensure a minimum float buoyancy and to rigidize and strengthen the float drum and includes an inflatable material that is at least partially filled with a gas and/or liquid to control the buoyancy of the float drum. In still a further preferred embodiment, the inflatable material is in fluid communication with one or more openings in the float drum. In yet another preferred embodiment, the inflatable material is at least partially positioned in one or more compartments in the interior of the float drum. In another preferred embodiment, the inflatable material only partially fills the interior of the float drum. In still another preferred embodiment, one or more inflatable materials are the only flotation control device in the interior of the float drum.

In accordance with still yet another feature of the present invention, the float drum includes at least one valve or opening. The valve or opening allows the volume and/or type of fluid within the float drum and/or components in the float drum to be adjusted, controlled and/or regulated. Preferably the valve or opening is self sealing or sealable to inhibit fluids from uncontrollably entering or escaping though the valve or opening. In one preferred embodiment, the valve or opening is positioned near or on the top of the float drum to provide for easy access to the valve or opening. In another preferred embodiment, the valve is a pressure sensitive valve which releases fluid from the interior of the float drum and/or components in the interior of the float drum upon detecting a pressure that is greater than a predetermined threshold pressure. In still another preferred embodiment, the valve allows relatively high pressure gasses to be inserted into and maintained in the float drum and/or components in the float drum. In yet another preferred embodiment, the valve allows an operator to check the pressure within the float drum and/or components in the float drum to verify the integrity of the float drum and/or internal components to identify ruptures, cracks or leaks in the float drum and/or such components. In still yet another preferred embodiment, the valve or opening is in fluid communication with one or more compartments and/or components in the interior of the float drum. In another preferred embodiment, the size of the opening is selected to allow an operator to insert and/or remove components in the float drum, clean the interior of the float drum, inspect the interior of the float drum, and/or access and repair the interior of the float drum. In still another preferred embodiment, the float drum includes a plurality of the openings or valves which are in fluid communication with the interior of the float drum and/or one or more compartments and/or components in the float drum. In a further embodiment, at least one opening includes a plug to seal the opening and inhibit fluids from entering and/or exiting the interior of the float drum and/or components in the float drum.

In accordance with another feature of the invention, the bottom wall portion of the float drum has a bottom wall, a pair of contiguous side walls extending from the sides of the bottom wall and a pair of contiguous end walls extending from the ends of the bottom wall. Each end wall is contiguous with a side wall and each side and end wall terminates in the load bearing bottom side flange which circumscribes the bottom wall portion and extends away from the side and end walls. The top wall portion of the float drum has a top wall, a pair of contiguous end walls extending from the ends of the top wall and a pair of contiguous side walls extending from the sides of the top wall with the end and side walls terminating in the load bearing rigidizing top side flange. Preferably, the top wall of the top portion of the float drum is generally flat and substantially rectangular in cross-sectional configuration. Preferably, the side walls and bottom wall of the bottom portion are substantially flat.

In accordance with still another feature of the present invention, at least one of the side walls and/or end walls of the bottom portion includes at least one flange supporting rib integrally formed therein and interrupting the flatness of the side wall. In one preferred embodiment, at least one of the side walls and/or end walls of the bottom portion includes at least one indention. In another preferred embodiment, the bottom wall portion of the float has a bottom wall, a pair of contiguous side walls extending from the sides of the bottom wall and a pair of contiguous end walls extending from the ends of the bottom wall. Each end wall is contiguous with a side wall and each side and end wall terminates in the load bearing bottom side flange which circumscribes the bottom wall portion and extends away from the side and end walls. At least one of the side walls is relatively flat and preferably has at least one flange supporting rib integrally formed therein and interrupting the flatness of the side wall. At least one end wall also preferably includes a flange supporting rib integrally formed therein. The rib preferably has the shape of a semi-circular truncated cone with the larger diameter portion integral with the bottom side flange and its smaller diameter portion somewhat adjacent the bottom wall. However, the rib may have other shapes. The side walls and bottom wall preferably includes at least one indention. Preferably the indentions are aligned to form a continuous indention from the side wall, to the bottom wall and ending on the other side wall. The top wall portion of the float drum has a top wall, a pair of contiguous end walls extending from the ends of the top wall and a pair of contiguous side walls extending from the sides of the top wall with the end and side walls terminating in the load bearing rigidizing top side flange. The top wall of the top portion of the float is generally flat and partially rectangular in cross-sectional configuration.

In accordance with yet another feature of the present invention, the interior of the float drum and/or one or more components in the float drum includes a substantially inert fluid. The selected fluid is designed to not react with the float drum and/or components in the float drum. Fluids such as air and water can cause corrosion in the interior of a metal float and/or corrode one or more components in the float. These types of fluids also promote or allow various type of microorganisms to live and grow. In one preferred embodiment, the fluid is a substantially inert gas or liquid which fluid does not or substantially does not cause corrosion of the float drum material or components in the float drum; is at least substantially non-reactive or non-volatile with fresh water or sea water environments, is substantially environmentally friendly, and/or inhibits or prevents the growth of microorganisms in the float drum.

In accordance with still yet another feature of the present invention, the top portion of the float drum includes a utility channel to accommodate utility pipes, wires, etc. The utility channel can be a depression in the top portion of the float drum, and/or a structure extending up from the top portion of the float drum. The utility channel can be designed to rigify/strengthen the top portion of the float drum, and/or assist in positioning the float drums in a particular arrangement. In one preferred embodiment, the utility channel is a groove in the top portion of the float drum and has a depth such that the utility components can be placed within the groove and secured in the groove when the deck boards are placed on the top portion of the float drum.

In accordance with another feature of the present invention, the top portion flange includes one or more markers to indicate reference points for inserting holes into the flange and/or for orienting two or more float drums within a dock system. In one preferred embodiment, the top side flange does not include holes for attachment of decking thereby requiring holes to be inserted into the top portion flange prior to attaching decking or the like to the float drum. The reference markers provide a visual marker on the top flange portion to allow the installer to easily install the float drums and dock structure.

In accordance with still another feature of the present invention, the float drum includes a stabilizer to stabilize the float drum in a liquid medium. The stabilized is designed to reduce the movement of the float drum in a liquid medium having rapid liquid level changes and/or waves and/or from movement due to wind. The stabilizer can include weights, baffles, flanges, diffusers, or the like. In one preferred embodiment, the stabilizer is connected at or near the bottom of the float drum. In another preferred embodiment, the stabilizer includes a plastic and/or metal structure connected to the metal base of the float drum. In still another preferred embodiment, the stabilizer includes at least one plate spaced from and lying in a plane substantially parallel to the base of the float drum. The plate may include one or more openings. In yet another preferred embodiment, the stabilizer includes a weight and/or other relatively dense materials positioned in the base and/or connected to the base of the float drum.

In accordance with still yet another feature of the present invention, the float drum includes a seal between the top and bottom portions of the float drum. The seal is designed to inhibit the flow of fluids into and/or out of the interior of the float drum via the flanges of the top and bottom portions of the float drum. The seal can be, but is not limited to, a rubber or plastic gasket, glue, sealant, weld or solder bead, or the like. In one preferred embodiment, a rubber or plastic gasket is positioned between the top and bottom portion flange to form a substantially fluid tight seal when the top and bottoms portions as secured together. In another preferred embodiment, the top portion and/or bottom portion includes a groove to receive the seal. In still another preferred embodiment, the seal is spaced from the outer edge of the top and bottom portion flange.

In accordance with another feature of the present invention, the float drum and/or one or more components in the float drum are designed to self seal when a rupture or leak forms in the body of the float drum and/or one or more components in the float drum. The self sealing design inhibits or prevents fluids in the float drum and/or in one or more components in the float drum from escaping and/or inhibits or prevents fluids from entering the float drum and/or one or more components in the float drum. The self sealing float design will vary depending on the type or types of sealants. In one preferred embodiment, the sealant includes rubber or a rubber compound or derivative; an acrylate compound or derivative, a glycidyl compound or derivative, an acrylic compound or derivative, polyurethane compound or derivative, latex, and mixtures thereof. The sealant preferably has a viscosity which allows the sealant to move into a ruptured and/or punctured region to seal such viscon. Solvents and the like may be included in the sealant to adjust the viscosity. In another preferred embodiment, the sealant is maintained in close proximity with the interior walls of the float drum by a rigid or flexible wall; fabric material; plastic or rubber tape or wrap; or the like. The wall, tape or wrap such as rubber, synthetic elastomer, or the like can also function in combination with the sealant to seal a rupture or leak in the float drum. In still another preferred embodiment, the sealant is placed on an inflatable material to seal a ruptured and/or punctured region in the inflatable material. In yet another preferred embodiment, the sealant is water activated.

It is the principal object of the present invention is to provide a dock supporting float drum which is environmentally friendly and highly durable and essentially unsinkable over long term use and abuse in a variety of environments.

It is another object of the present invention to provide a float drum which is corrosion resistant and puncture resistant.

It is still another object of the present invention to provide a float drum which does not sink when the integrity of the float is compromised.

It is yet another object of the present invention to provide a float drum having a controlled buoyancy.

It is still another object of the present invention to provide a float drum which includes a valve or opening to control the fluid content of the float drum.

It is still yet another object of the present invention to provide a float drum which can easily accommodate a utility system.

It is another object of the present invention to provide a float drum which includes visual indications for drilling holes to attach a structure to the float drum.

It is yet another object of the present invention to provide a float drum which buoyancy is easily controlled.

It is still another object of the present invention to provide a float drum having improved stabilization in a liquid medium.

It is further object of the present invention to provide a float drum which interior does not corrode.

It is still a further object of the present invention to provide a float drum which inhibits the growth of organisms in the float drum.

It is another object of the present invention to provide a float drum which can be pressure stabilized throughout the seasons of the year.

It is still another object of the present invention to provide a float drum which includes a plurality of compartments and/or components in the float drum.

It is yet another object of the present invention to provide a float drum which does not have buckled or bowed walls and/or is produced within consistent closely controlled dimensional tolerances.

It is still yet another object of the present invention to provide a float drum with one or more seals to inhibit the uncontrolled flow of fluids into and out of the interior of the float drum.

It is another object of the present invention to provide a float drum which self seals when a leak forms in the body of the float drum and/or one or more components in the float drum.

It is yet another object of the present invention to provide a float drum with one or more buoyancy control devices in the interior of the float drum.

It is still yet another object of the present invention to provide a float drum having a seal to prevent leakage about the flange of the float drum.

It is another object of the present invention to provide a two piece metal float drum.

It is yet another object of the present invention to provide a single piece plastic float drum.

It is a further object of the present invention to provide a float drum having an inflatable material in the float drum to control the buoyancy of the float drum.

It is still a further object of the present invention to provide a float drum that can be easily monitored to determine the structural integrity of the float drum.

These objects and other features of the present invention will become apparent to those skilled in the art from a reading and understanding of the following detailed description of the specification taken together with the accompanying drawings.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE PREFERRED EMBODIMENT

Figure 1:
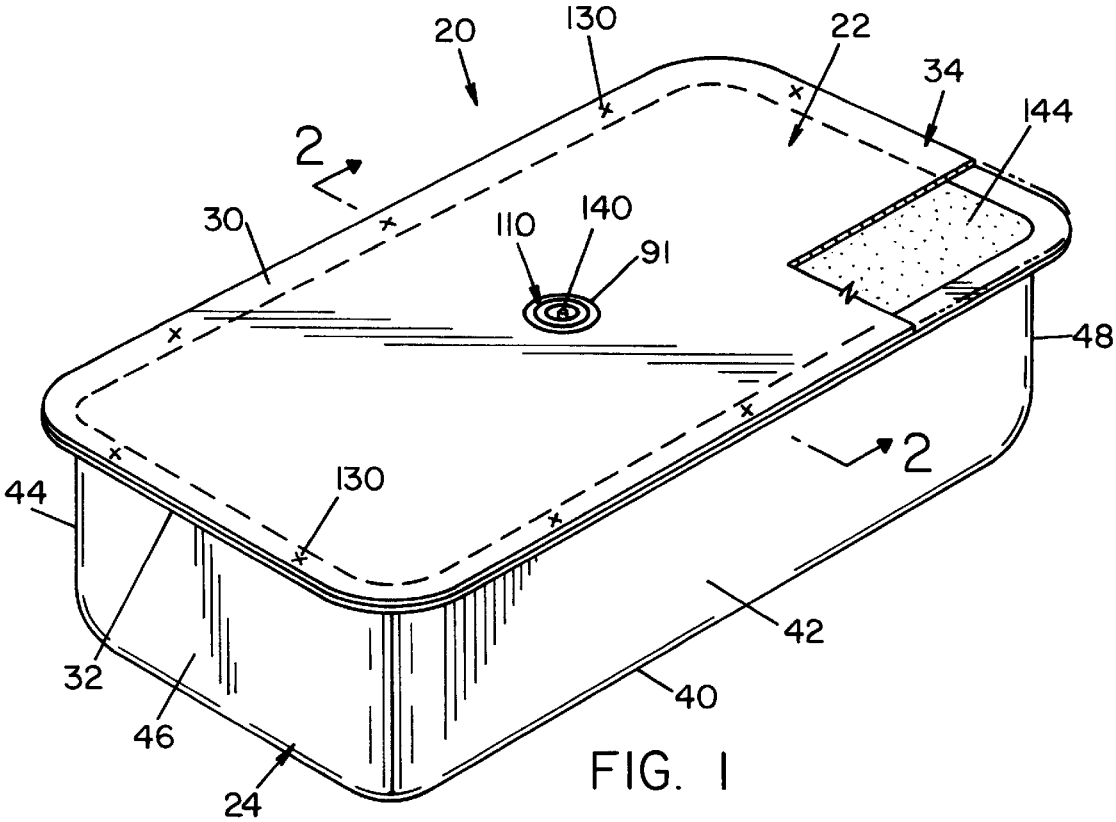
FIG. 1 is a perspective view of the float drum embodying the present invention.

Referring now to the drawings wherein the showings are for the purpose of illustrating the preferred embodiment of the invention only and not for the purpose of limiting the same, FIG. 1 shows a float drum 20 for supporting marine structures and the like. Float drum 20 has a top portion 22 which includes a circumscribing top flange 30. Float drum 20 has a configured bottom hollowed portion 24 which includes a circumscribing bottom flange 32. In one embodiment, top flange 30 is heat fused or welded to bottom flange 32 to produce an integral load bearing flange 34 circumscribing float drum 20. In another embodiment, float drum 20 is blow molded thus top flange 30 and bottom flange 32 are formed as an integral load bearing flange 34. Top and bottom hollowed portions 22, 24 define a space or an enclosure which has a predetermined configuration defined by the interior surfaces of the top and bottom portions.

Circumscribing flange 34 is a load bearing rigidizing support flange and can take the shape of a spaced-a-part configuration or the flanges can simply abut one another. For the float drum illustrated in FIG. 1, the flange arrangement simply abut one another.

Float drum 20 is configured in a shape which rigidizes the float walls while also providing a configuration which can receive or nest various standard risers of structural lumber (principally 2×4's and 2×6's) or metal shapes to permit the float drum to be mounted in a variety of positions to the marine structure or alternatively to be cross braced with appropriate stringers and the like. The term "marine structure" as used herein, broadly means any structure which is to be placed in water for support purposes. Examples of marine structures are docks, swim rafts, pipe line support structures, etc.

Bottom portion 24 is defined by generally rectangular bottom wall 40. Extending upwardly from opposite sides of bottom wall 40 are side walls 42, 44 which terminate in bottom flange 32. Similarly, extending from the ends of bottom wall 40 are end walls 46, 48 which likewise extend upwardly and terminates at bottom flange 32. Top portion 22 has a top wall 70. Top wall 70 is contiguous with and terminate at top flange 30 which, like bottom flange 32, extends outwardly away from top wall 70. The top portion 22 and bottom portion 24 are made of a corrosion-resistant material. The top and bottom portions are preferably made of the same material; however, the material for the top portion may be different from the bottom portion. The corrosion-resistant materials are also preferably puncture resistant. The materials include, but are not limited to hard plastics, hard rubbers, fiberglass containing materials, corrosion-resistant metals, and the like. If the top and/or bottom portion of the float drum are made of a plastic material, the plastic material preferably is a polyethylene material. If the top and/or bottom portion of the float drum are made of a metal, the metal is preferably stainless steel.

A float drum made of a plastic material can be formed by a blow molding process or by a twin sheet process. The method of forming top portion 22 and bottom portion 24 by blow molding or by a twin sheet process is known in the art and will not be described in detail. In a twin sheet process, top portion 22 is formed from a sheet of a fusible, thermal plastic material and bottom portion 24 is formed from another sheet of a fusible, thermal plastic material. Preferably, the sheets are polyethylene; however, polyvinyl chloride is an example of another plastic material that can be used. However, reference should be had to the patents incorporated by reference herein which describe in greater detail the range of plastics from which float drum 20 can be manufactured by means of the twin sheet process. Basically, the polyethylene sheets in a twin sheet process are initially heated by means of heaters to a sag condition. One sheet is positioned over a generally fixed or immovable stationary die which is formed in the shape of bottom portion 24. A plurality of passages formed in the stationary die which communicate with the interior of the die to permit a vacuum to be drawn through the die so that sheet is pulled into the configuration of the die. Top portion 22 can be formed from a thinner sheet typically 0.090 inches when compared to bottom portion 24 which is preferably formed from a thicker sheet of plastic, i.e. 0.200 inches. However, the thickness of top portion 22 and bottom portion 24 can be substantially the same. Because bottom portion 24 is deeper than top portion 22 and because bottom portion 24 has a specially shaped configuration, a plug may be used when forming the bottom sheet into the configuration of bottom portion 24. The sheet for top portion 22 is drawn into its configuration by a movable die which has vacuum openings to draw the sheet into the desired configuration. Because of the relatively shallow dimension of top portion 22, a plug is not necessary to form top portion 22 in the movable die. Once top portion 22 and bottom portion 24 are formed, top flange portion 30 is fused with bottom flange portion 32 to produce an integral flange 34. As can be appreciated, the top and bottom flange can be connected together in other ways such as by forming a melted seam, adhesive, clamps, bolts, screws, rivets, interlocks, or the like. The polyethylene is allowed to cool to its hardened state while the dies remain mated to one another. After the polyethylene has cooled, air is injected through the openings in the dies and the dies are uncoupled and the float drum removed. In a blow molded process, one piece of plastic is formed into the float drum. The top flange and bottom flange are formed together and need not be subsequently fused together to form the integral flange.

A float drum made of a metal material is generally form from two pieces. The top and bottom portions can be formed by a die or a mold. The top flange and bottom flange are then connected together by a weld, adhesive, bolts, screws, rivets, interlocks, clamps, or the like.

Figure 11:
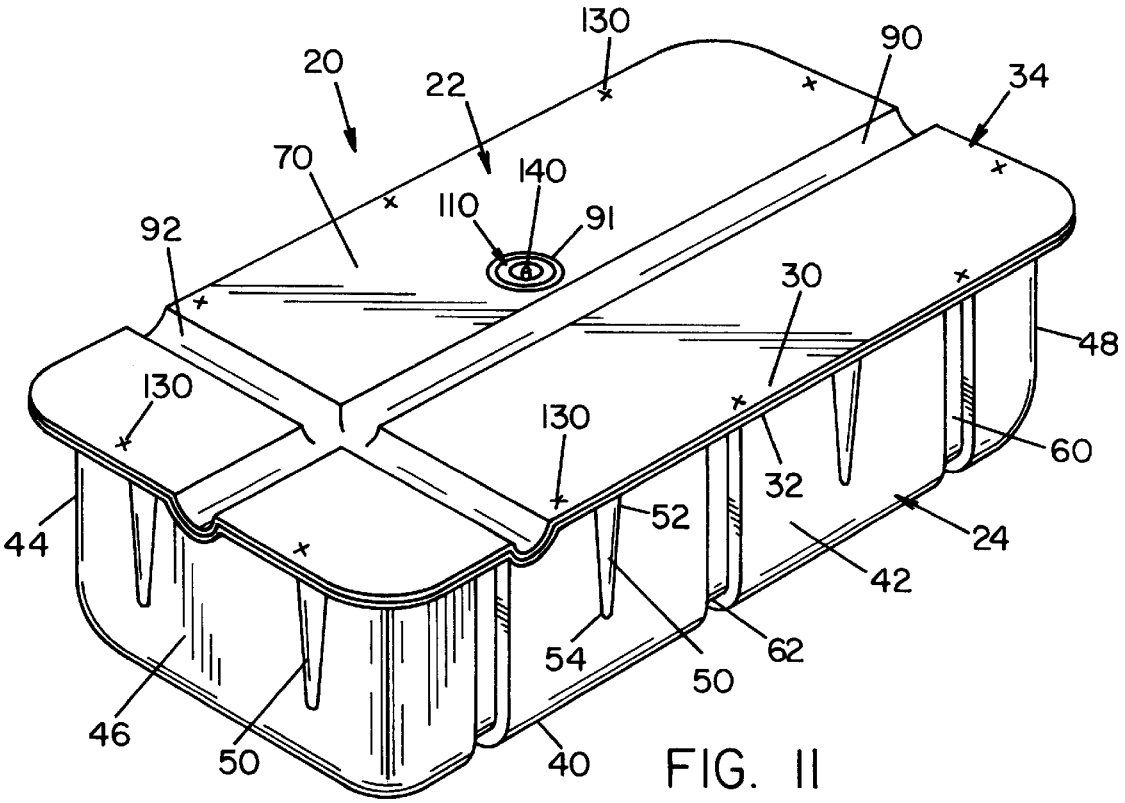
FIG. 11 is a perspective view of another embodiment of the float drum embodying the present invention.

As shown in FIG. 1, the top portion 22 and bottom portion 24 have generally smooth surfaces. Preferably, float drums made of a stainless steel have surfaces as shown in FIG. 1. An alternative float drum arrangement is illustrated in FIG. 11. In FIG. 11, the top portion and bottom portion include at least one rib and/or indention to increase the rigidity and/or strength of the top and bottom portion. Float drums having ribs and/or indentions are preferably made of plastic materials; however, metal float drums can also include ribs and/or indentations.

Referring now to FIG. 11, a plurality of flange supporting ribs 50 are molded into side walls 42, 44 and end walls 46, 48 to support load bearing flange 34 while rigidizing bottom portion 24. Ribs 50 are essentially columnar supports which extend from the underside of bottom flange portion 32 to a position somewhat adjacent bottom wall 40 and for the float drum shown are generally in the shape of a semi-circular truncated cone having its larger diameter portion 52 adjacent and integral with bottom flange 32 and its minor diameter portion 54 adjacent bottom wall 40. As can be appreciated, the flange support ribs 50 can have other shapes. Side walls 42, 44 and bottom wall 40 are generally flat and to increase their rigidity, side wall indentations 60 are provided in side walls 42, 44 and bottom wall indentations 62 are provided in bottom wall 40 with bottom wall indentations 62 lined with side wall indentations 60. The indentations 60, 62 can be viewed as rectangularly depressed slots which extend the entire length of side walls 42, 44 and bottom wall 40. Optionally or in addition, indentations can be provided in end walls 46, 48. As can be appreciated, the indentions can have other shapes. Top portion 22 has a top wall 70. Top wall 70 is contiguous with and terminates at top flange 30 which, like bottom flange 32, extends outwardly away from top wall 70. As was done for bottom portion 24, top portion 22 can be rigidized by one or more indentations formed in the substantially flat top wall 70. The indentation(s) can extend about the perimeter of top wall 70 and/or along the lateral or longitudinal length of the top wall. As shown in FIG. 11, top wall 70 includes two structural ribs 90, 92. Structural rib 90 is designed to extend the complete longitudinal length of top portion 22. Structural rib 92 is designed to extend the complete lateral length of top portion 22. Structural ribs 90, 92 are dimensionally sized to permit pipes, cables, electrical wires and the like to be nested therein. The structural ribs are also designed to rigify top portion 22. The structural ribs 90,92 are semicircular in shape; however, other shapes can be used. The structural ribs are shown to be depressed in top wall 70. As can be appreciated, water is channeled to the structural ribs and directed off of the float drum. In the embodiment shown in FIG. 11, structural rib 90 is positioned substantially in this middle of top portion 22 and structural rib 92 is positioned nearer to one end of top portion 22 thereby forming a cross-like shape on top wall 70. Structural rib 90 is preferably placed in the middle of top portion 22 to evenly distribute the load along the longitudinal length of the float drum. The lateral length of top portion 22 is less than the longitudinal length, thus the positioning of structural rib 92 does not as greatly affect the load distribution on the float drum. As can be appreciated, structural rib 92 can be positioned in other locations on the top wall to redistribute the load. Generally, the longitudinal length of the top portion is about 1.5–4 times the lateral length of the top portion. In one particular embodiment, the lateral length of the top portion is about two feet, the longitudinal length of the top portion is about four feet, structural rib 90 is spaced about 6–12 inches from the side of the top portion and structural rib 92 is spaced about 6–24 inches from the side of the top portion.

Referring again to FIGS. 1 and 11, top wall 70 includes a recess 91 which includes an opening 100. The opening can be used to place a floatation substance such as urethane foam, polystyrene, etc. into the interior of the float drum, pressurize the interior of the float drum, place inflatable materials in the float drum, and/or add or remove fluids from the float drum. As can be appreciated one or more openings can be formed in the top wall.

As best shown in FIGS. 1 and 11, the top flange includes attachment indicators 130 positioned on top flange 30. Indicators 130 mark a position wherein a dock structure can be attached to the float drum. Indicators 130 are suggested points of attachment and can be used as reference points when connecting a plurality of float drums to a dock system. Indicators 130 are preferably a marking of some type that may include small depressions or small raised points in the top flange, painted or other colored markings, small holes, etc.

Figure 2:
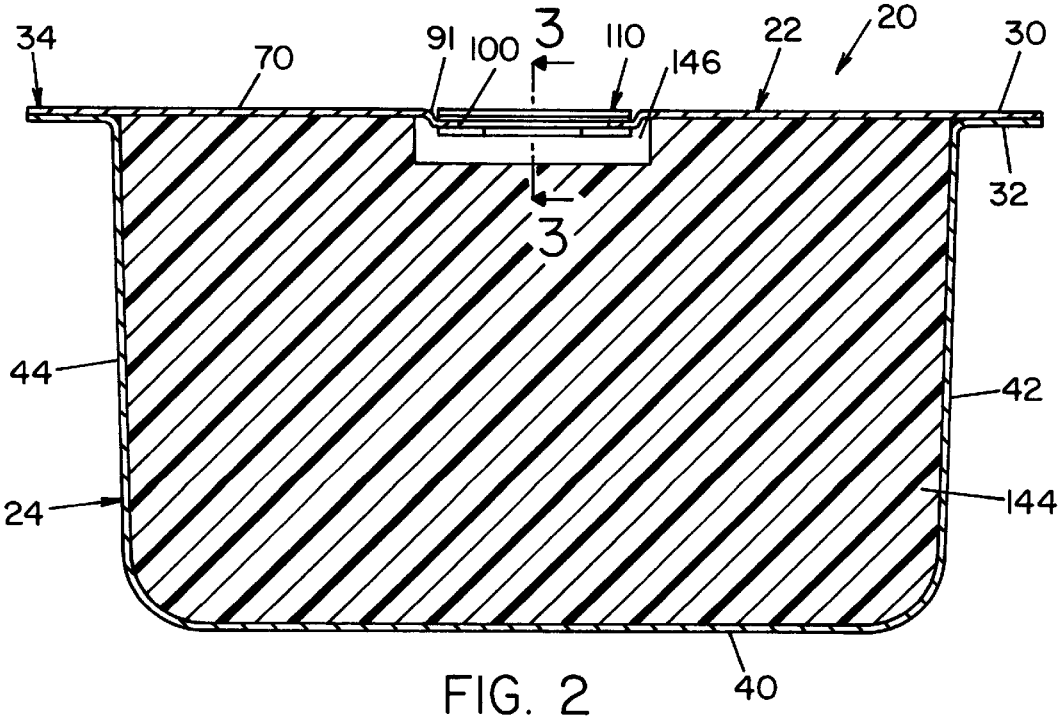
FIG. 2 is a cross-sectional view along line 2—2 of FIG. 1 illustrating a flotation material in the interior of the float drum.

Referring now to FIG. 2, the float drum is shown to be filled with a flotation substance 144 such as preformed foam core, and/or an injected foam. If a preformed core is used, it is preferably made of any lightweight, floatable material which can be inserted into the float drum prior to connecting top flange 30 and bottom flange 32 together. Any conventional lightweight, buoyant plastic material can be used and those skilled in the art will readily recognize such plastics and thus various plastic compositions are not set forth herein. Preferably, a plastic composition with good compressive strength is chosen. A material that has been found acceptable is polystyrene. The composition of the core is chosen such that a core having a good compressive strength is produced. The float drum 20 can be formed by placing the foam core in bottom portion 24 prior to covering the core with top portion 22. As shown in FIG. 2, the core is shaped so that the inside surfaces of the bottom portion fit generally tightly against all the external surface of the preformed core. This provides a support for all of the wall surface area of float drum 20 and rigidizes the entire float drum. In some applications, the core allows the wall thickness of the float drum to be reduced due to the added rigidity produced by the core.

Another method of placing a flotation substance 144 into the interior of float drum is by blowing foam through opening 100 or pouring plastic beads or pellets in one or more of opening 100 and subsequently heating the beads or pellets until they expand and cure to form a flotation substance which fills the interior of the float drum. Many types of plastics can be used. One particular plaster is styrene beads. These beads can be rapidly inserted into float drum 20 through opening 100. After the beads are placed into the float drum, the beads are heated. One method of heating is to place a heating rod into opening 100. Once the plastic beads have been sufficiently heated, the heating rod is removed from the opening and the opening is closed.

Figure 2A:
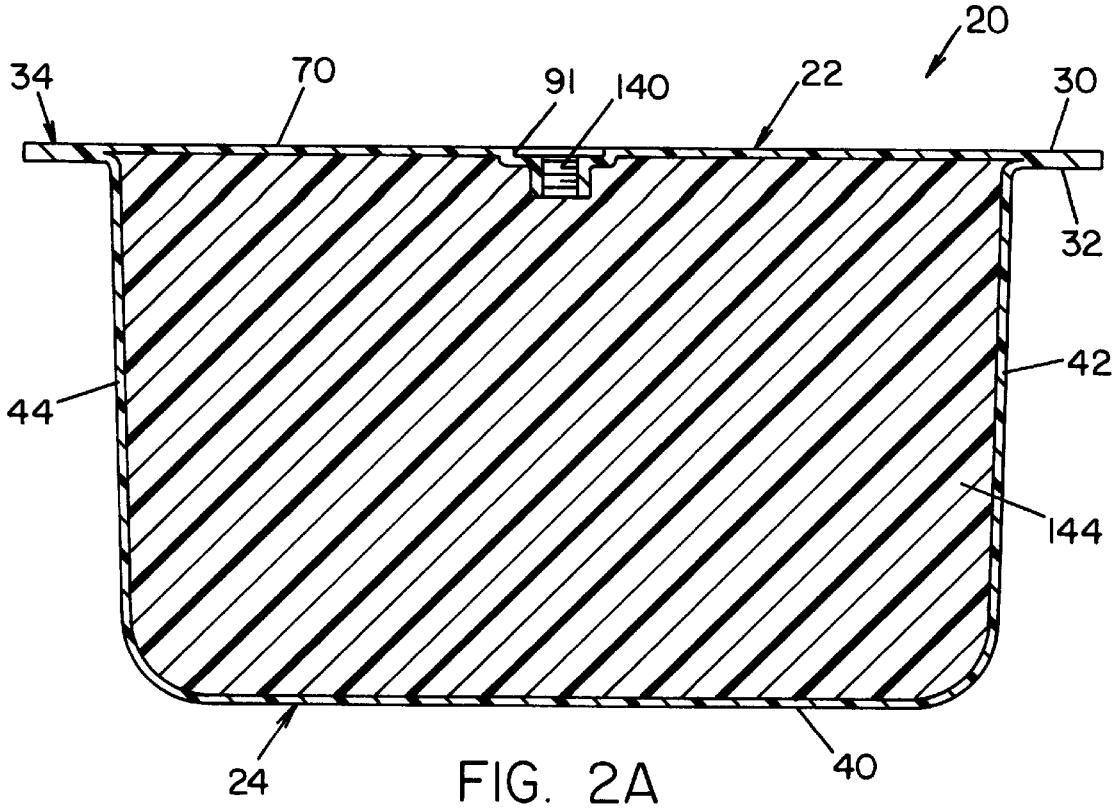
FIG. 2A is a cross-sectional view of a one piece float drum illustrating a flotation material in the interior of the float drum.
Figure 3:
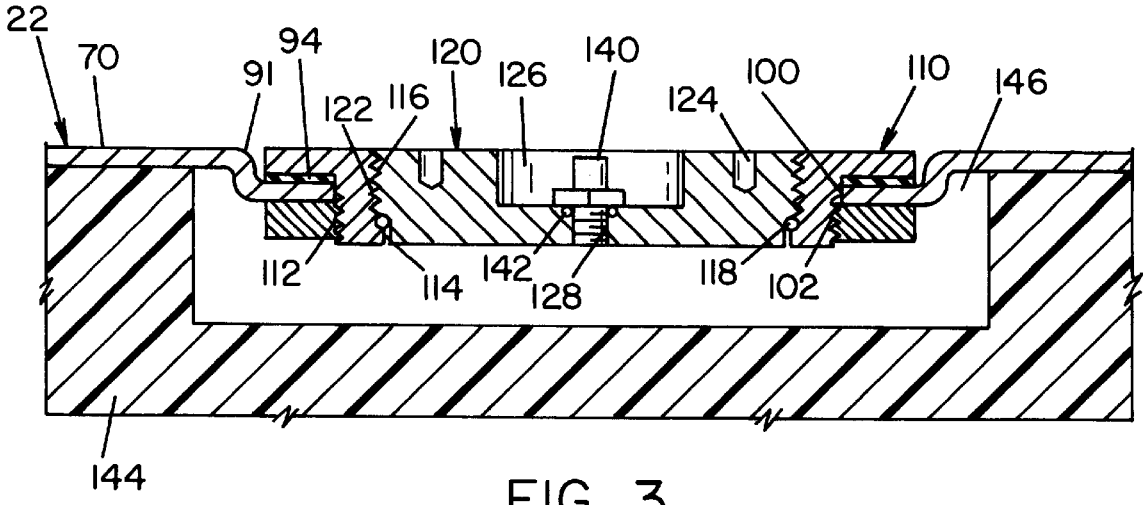
FIG. 3 is a cross-sectional view along line 3—3 of FIG. 2.

Referring now to FIGS. 2, 2A and 3, opening 100 is sealed by a cap 110. Cap 110 can be screwed, glued, welded, locked, etc. in opening 100. Preferably cap 110 is designed to be removable from opening 100. As shown in FIG. 3 cap 110 is a generally cylindrical piece which includes grooves 112 and an opening 114. Grooves 112 are designed to be screwed into threads 102 in opening 100 as shown in FIG. 3. Cap 110 is sealed in opening 100 by a seal 94. Seal 94 is preferably a plastic or rubber O-ring or gasket; however, the seal can be some other material such as a sealing gel, pressure tape or the like. Cap 110 is shown to include a lid 120 which is positioned in cap opening 114. Lid 120 includes grooves 122 that are designed to be screwed into threads 116 of cap 110. Lid 120 includes two slots 124 to allow an operator to unscrew or screw lid 120 into cap 110. Lid 120 is sealed in cap 110 by a seal 118. Seal 118 is preferably a plastic or rubber O-ring or gasket; however, the seal can be some other material such as a sealing gel, pressure tape or the like. Lid 120 also includes a recess 126 having an opening 128. A regulator 140 is designed to be inserted into opening 128 of lid 120. Regulator 140 can be a plug or a valve. Regulator 140 is sealed in opening 128 by a seal 142. Seal 142 can be a plastic or rubber O-ring or gasket; however, the seal can be some other material such as a sealing gel, pressure tape or the like. Recess 126 is designed so that the top of regulator 140 is flush with or recessed below the top of lid 120. Recess 90 on top wall 70 is designed so that cap 110, lid 120 and regulator 140 are flush with or recessed below top wall 70 so as to protect these components from being damaged when dock structures are placed on top wall 70. Cap 110, lid 120 and regulator 140 seal opening 100 when inserted and substantially prevents fluids from entering or exiting the interior of float drum 20.

Referring to FIG. 2, float drum 20 is a two piece structure that includes a preformed core inserted into the bottom portion 24 prior to positioning and securing top flange and bottom flange together. Due to the nature of using a preformed core, a small space 146 exists between the core and the cap, lid and regulator. Preferably, the top and bottom flange are connected together to form a substantially fluid tight seal.

Figure 10:
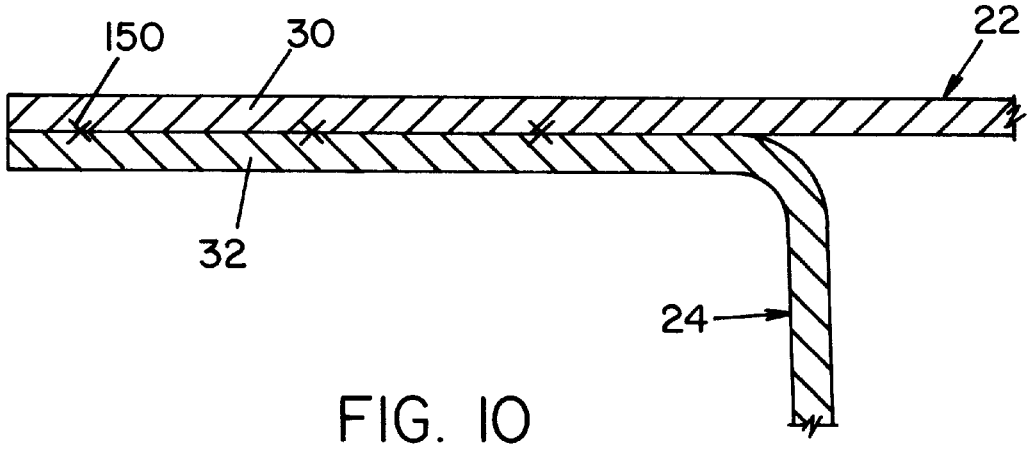
FIG. 10 is an enlarged sectional view of the flange of the float drum illustrating one embodiment of connecting together the flange.
Figure 10A:
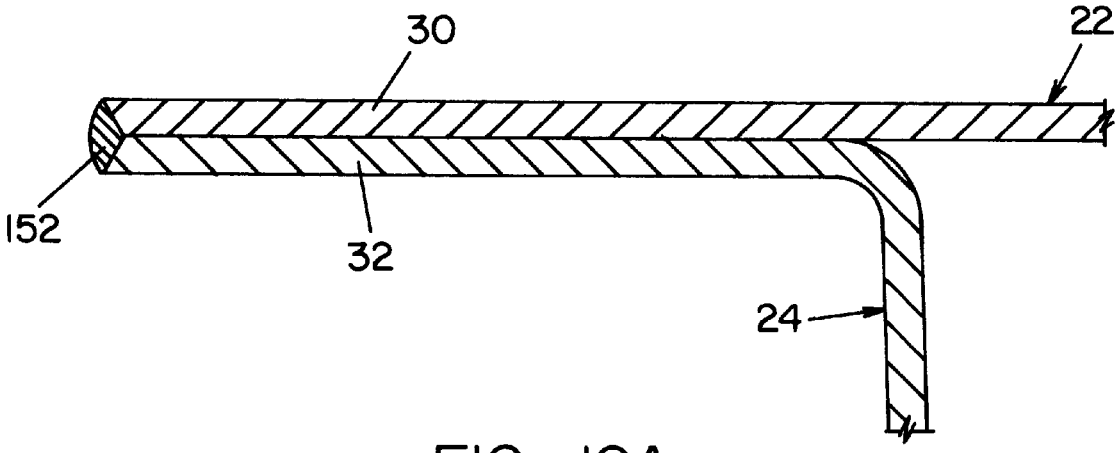
FIG. 10A is an enlarged sectional view of the flange of the float drum illustrating another embodiment of connecting together the flanges.
Figure 10B:
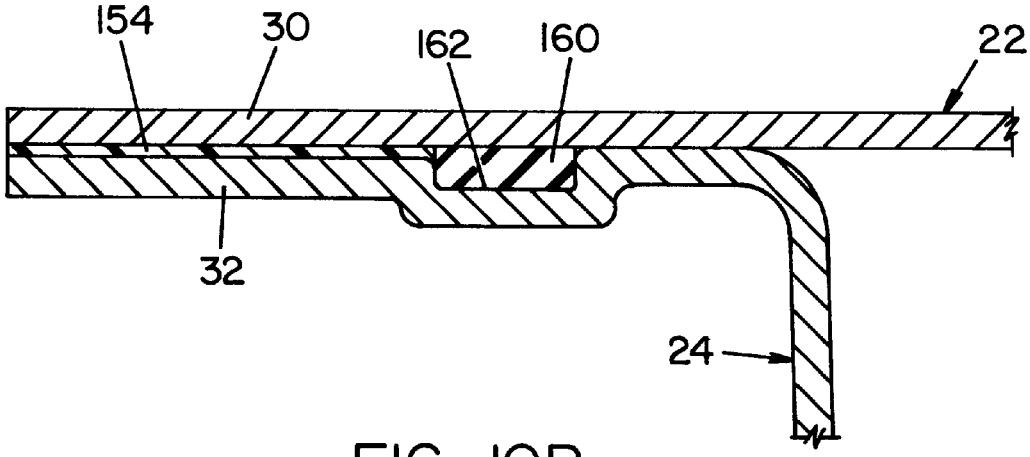
FIG. 10B is an enlarged sectional view of the flange of the float drum illustrating still another embodiment of connecting together the flanges.
Figure 10C:
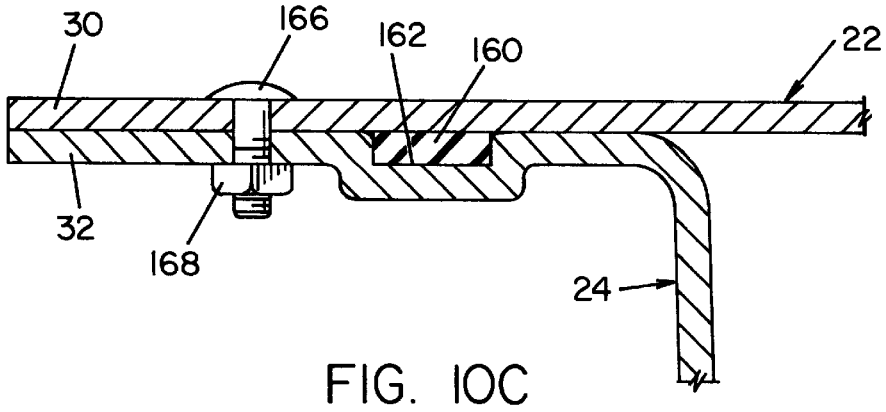
FIG. 10C is an enlarged sectional view of the flange of the float drum illustrating yet another embodiment of connecting together the flanges.
Figure 10D:
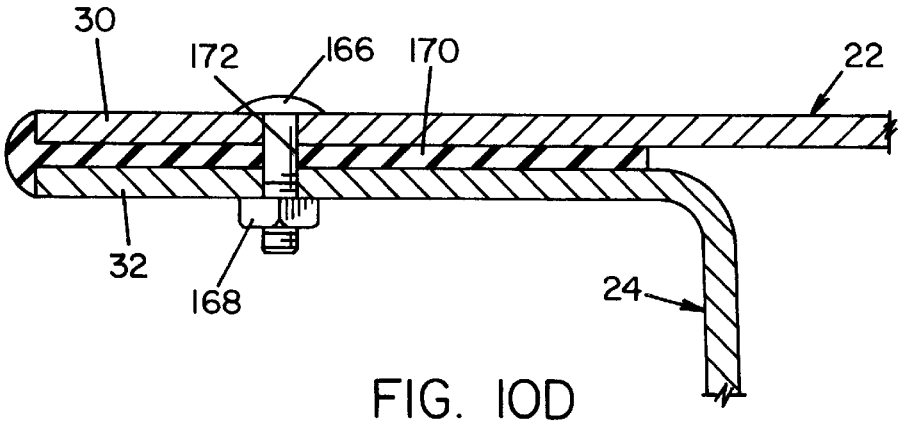
FIG. 10D is an enlarged sectional view of the flange of the float drum illustrating a further embodiment of connecting together the flanges.

Referring now to FIGS. 10–10D, several embodiments are illustrated to form the substantially fluid tight seal between the two flanges. Referring specifically to FIG. 10, top flange 30 and bottom flange 32 are connected together by spot welding or fusing 150 together the flanges at various points along the flange. A spot welding technique is preferably used for metal materials. The fusing of the flanges together by heat is preferably used for plastic materials. Referring now to FIG. 10A, top flange 30 and bottom flange 32 are connected together by spot welding or fusing 152 together the flanges at the ends of the two flanges. Referring now to FIG. 10B, top flange 30 and bottom flange 32 are connected together by an adhesive 154 positioned between the two flanges. Preferably, the adhesive is a water resistant, water tight adhesive. FIG. 10B also illustrates a seal 160 positioned between the two flanges. The seal 160 can be a plastic or rubber O-ring or gasket; however, the seal can be some other material such as a sealing gel pressure tape, or the like. The seal is shown to be positioned in a seal groove 162 which defines the position of the seal between the flanges and assist in maintaining the seal in place when the flanges are connected together. The seal is designed to form a substantially fluid tight connection between the two flanges. The seal is generally used to form a seal between two metal flanges; however, seal 160 can be used to seal together two plastic flanges. As can be appreciated, seal 160 can be positioned between the flanges in FIGS. 10 and 10A. Referring now to FIG. 10C, top flange 30 and bottom flange 32 are connected together by a bolt 166 and nut 168. The bolt and nut arrangement allows the flanges to be separated and reconnected as needed. A seal 160 is positioned between the two flanges. Seal 160 is positioned between the flanges to forms a substantially fluid tight seal between the flanges. Similar to FIG. 10B, seal 160 is positioned in a seal groove 162 which defines the position of the seal between the flanges and assists in maintaining the seal in place when the flanges are connected together. Referring now to FIG. 10D, top flange 30 and bottom flange 32 are connected together by a bolt 166 and nut 168 and a seal 170 positioned between the two flanges. The seal 170 can be a plastic or rubber O-ring or gasket; however, the seal can be some other material such as a sealing gel pressure tape or the like. Seal 170 is shown to be positioned between substantially the total surface of the flanges. An opening 172 is positioned in the seal to allow bolt 166 to be inserted through the seal. The end of the seal 172 extends beyond the end of the flanges to form a bumper at the end of the flanges. As can be appreciated, seal 172 can be positioned between the flanges in FIGS. 10 and 10A, and substituted for or used in combination with seal 160 of FIGS. 10B and 10C.

Referring now to FIG. 2A, a blow molded one piece float drum is illustrated which includes a floatation substance 144 that is blown in opening 100 or poured and subsequently heated. The floatation material is shown to substantially contact all the interior surfaces of the float drum thereby minimizing open spaces in the float drum.

Referring again to FIGS. 2 and 2A, regulator 140 is preferably a valve that allows an operator to add and/or remove fluids from the interior of the float drum. In one preferred embodiment, the pressure in the float drum is monitored to maintain a relatively constant pressure in the float drum throughout the year. The monitoring of the internal float drum pressure allows an operator to release pressure in the float drum if the pressure increases above a desired level thereby preventing the deformation of the float drum. The monitoring of the internal float drum pressure also allows an operator to add pressure in the float drum if the pressure decreases below a desired level thereby preventing the deformation of the float drum and/or preventing a vacuum to form in the float drum which vacuum can cause premature leaking of the float drum. As can be appreciated, the valve can be designed to automatically release pressure from the float drum when a high threshold pressure has been surpassed and/or to allow fluids to enter the float drum when the pressure in the float drum falls below a low threshold pressure. In another preferred embodiment, the pressure in the float drum is monitored to determine if leaks have formed in the float drum. In this embodiment, the valve is designed to allow the interior of the float drum to be pressurized. After pressurization, the pressure in the float drum is checked at a later time to determine if the pressure in the float drum has decreased. A decrease in the pressure indicates that the pressurized fluid is escaping from the float drum through a leak in the float drum. In still another preferred embodiment, the valve allows an inert fluid to be added to the interior of the float drum to inhibit or prevent internal corrosion of the float drum and/or to prevent microorganisms from growing in the float drum. One preferred fluid is an inert gas such as argon. In yet another preferred embodiment, the valve allows a dense fluid to be added and/or removed from the interior of the float drum to enable the regulation of the buoyancy of the float drum. The addition of a dense fluid in the float drum reduces the buoyancy of the float drum and causes the float drum to slightly sink in a liquid medium. The removal of a dense fluid from the interior of the float drum increases the buoyancy of the float drum and causes the float drum to slightly rise in a liquid medium. The control of the buoyancy of the float drum allows enable one to level a dock structure and/or enable the height of the dock structure to be adjusted over the liquid medium.

Figure 4:
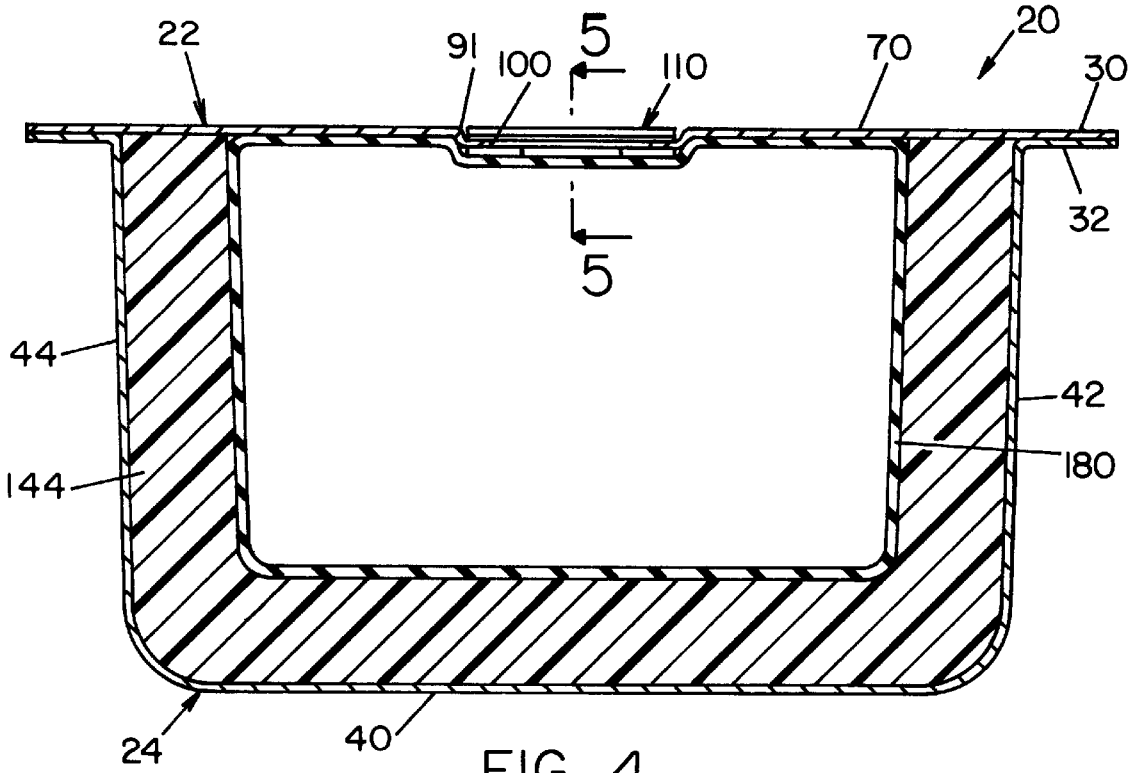
FIG. 4 is a cross-sectional view of another embodiment of the float drum illustrating a flotation material and an inflatable material in the interior of the float drum.
Figure 5:
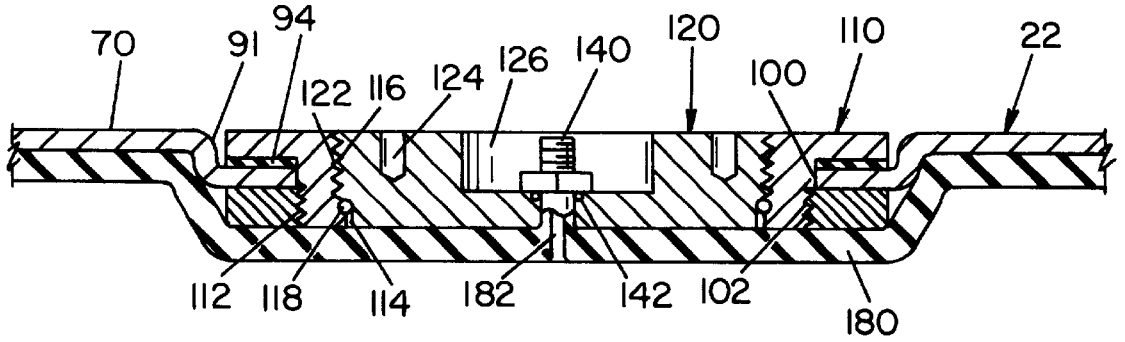
FIG. 5 is a cross-sectional view along line 5—5 of FIG. 4.

Referring now to FIG. 4, another embodiment of the float drum is disclosed. The float drum is a two piece unit that includes a floatation material 144 in the interior of the float drum. The floatation material is shown to only partially fill the interior of the float drum. The floatation material forms an inner shell in the interior of the float drum which is positioned next to side walls, end walls and the bottom wall of bottom portion 24. The design of the floatation material forms an inner void generally about the central interior of the float drum. An inflatable material 180, in its inflated state, is shown to substantially conform and fill the inner void. The inflatable material is made of durable material that resists being punctured. The inflatable material can be made of a stretchable material; however, the material need not be stretchable. Preferably, the inflatable material is a rubber material. The inflatable material is designed to be inflatable with a fluid such as a gas and/or a liquid. The type and/or amount of fluid in the inflatable material is used to control the buoyancy of the float drum and/or maintain a minimum level of buoyancy of the float drum. As shown in FIG. 5, regulator 140 is connected to mouth 182 of inflatable material 180. Mouth 182 is preferably connected to regulator 140 in a sealed relationship. Regulator 140 can be a plug or a valve. Preferably, regulator 140 is a valve that allows an operator to pressurize and depressurize the inflatable material.

Figure 6A:
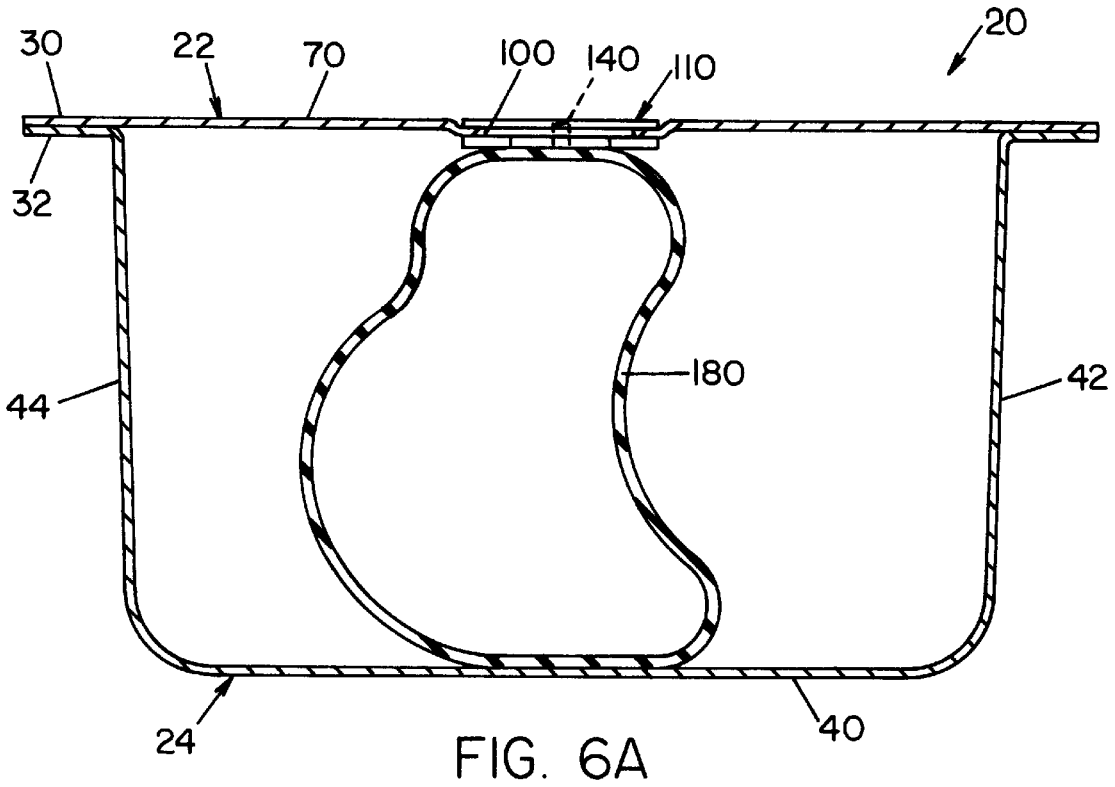
FIG. 6A is a cross-sectional view of yet another embodiment of the float drum illustrating a deflated or partially inflated inflatable material in the interior of the float drum.
Figure 6B:
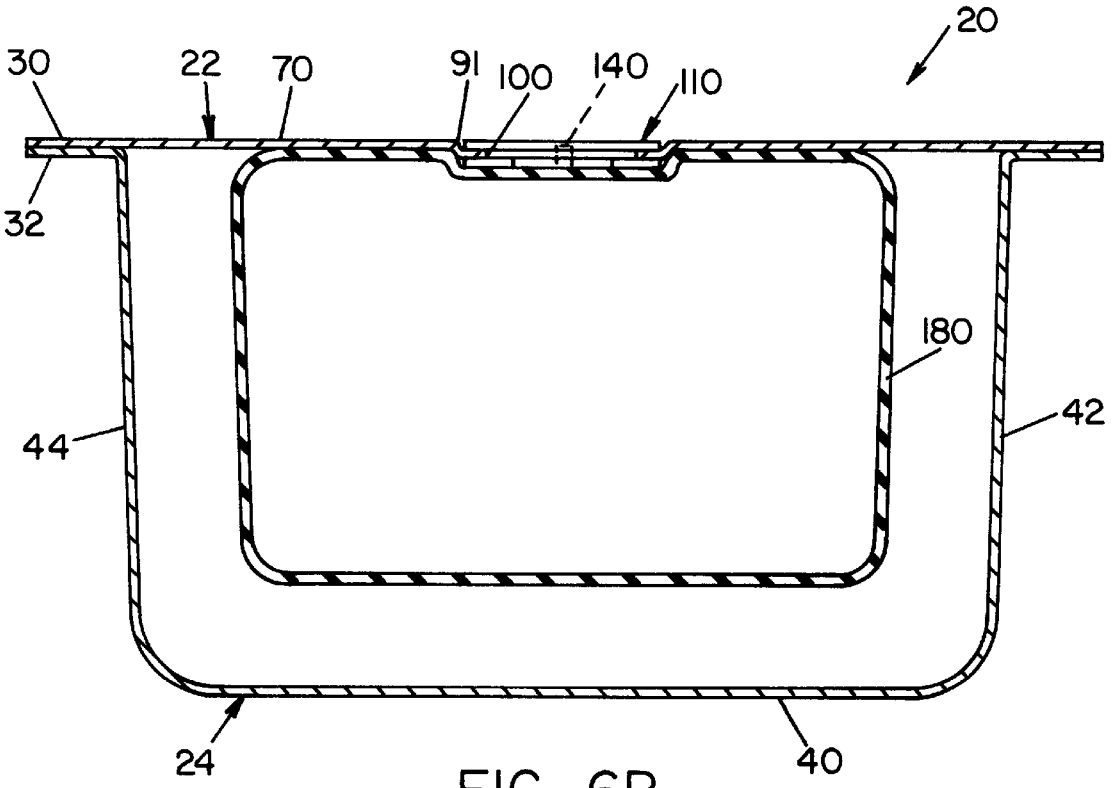
FIG. 6B is a cross-sectional view of the float drum as shown in FIG. 6A illustrating the inflatable material substantially or fully inflated.

Referring to FIG. 6A, float drum 20 includes inflatable material 180 in a deflated state. The float drum includes no other material in the interior of the float drum other than inflatable material 180. The float drum is shown as a two piece unit; however, the float drum can be a one piece blow molded float drum. The inflatable material 180 is the sole material to maintain a minimum buoyancy in the float drum in the event the float drum incurs a leak. As shown in FIG. 6B, inflatable material 180 is designed so that when inflated, the inflatable material is spaced from the interior of the bottom wall, side walls and end walls of the bottom portion of the float drum. The spacing of the inflatable material from the interior surfaces of the bottom portion is designed to protect the inflatable material from being damaged when the bottom portion of the float drum is punctured. Preferably, opening 100 is positioned substantially in the center of top wall 70 so as to center inflatable material 180 in the interior of the float drum when inflated; however, opening 100 can be positioned at other locations on top wall 70. Opening 100 is preferably sized so that inflatable material 180 can to inserted and/or removed from the interior of the float drum in the deflated state of the inflatable material. The use of only an inflatable material in the float drum has several advantages. When the inflatable material is damaged or worn, the inflatable material can be easily replaced or serviced by simply deflating the inflatable material and removing the inflatable material from the interior of the float drum through opening 100. The use of only the inflatable material also eliminates problems associated with the contamination and/or degradation of a floatation material in the float drum, and provides a greater range of buoyancy control of the float drum. In an alternative embodiment, a second opening is provided to allow an operator to add and/or remove fluids from the area in the interior of the float drum that is outside the inflatable material. The opening can be used to pressurize the float drum to check the integrity of the float drum, add inert fluids in the float drum and/or to add or remove dense fluids from the float drum to control or regulate the buoyancy of the float drum. In still a further embodiment, the float drum includes a single opening that allows controlled access the interior of the float drum and the interior of the inflatable material.

Figure 8:
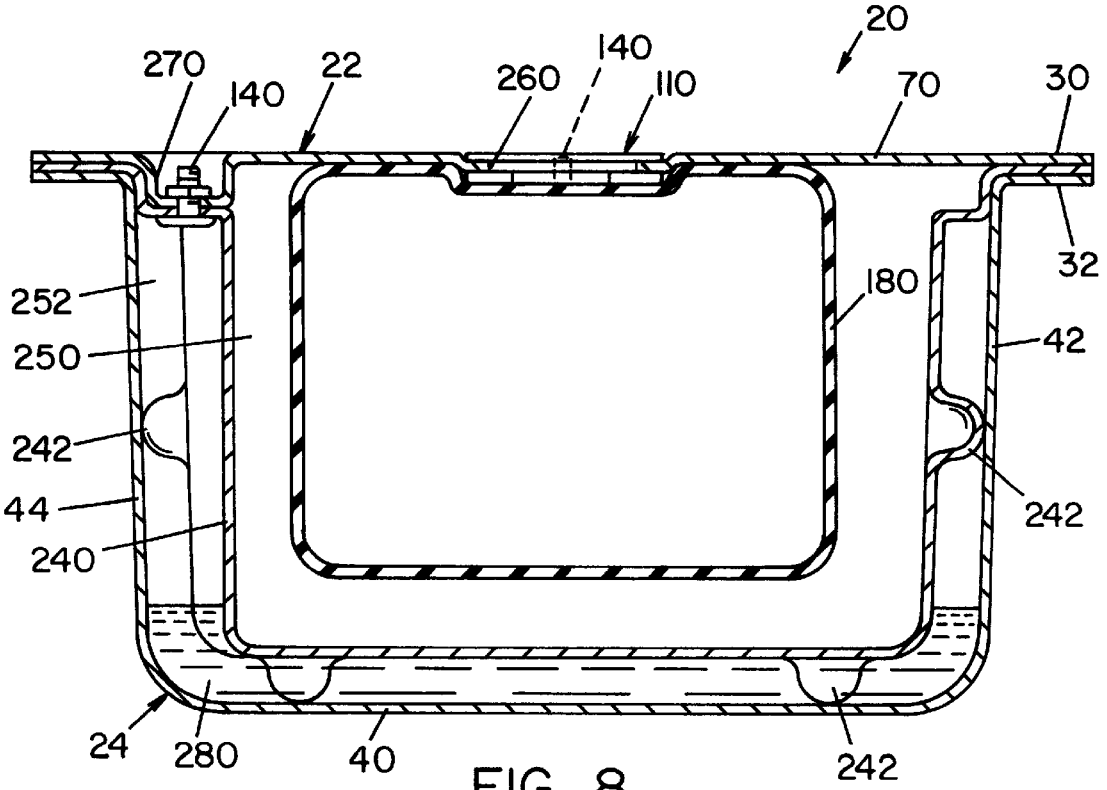
FIG. 8 is a cross-sectional view of a further embodiment of the float drum illustrating a two compartment interior having an inflatable material position in one compartment.
Figure 9:
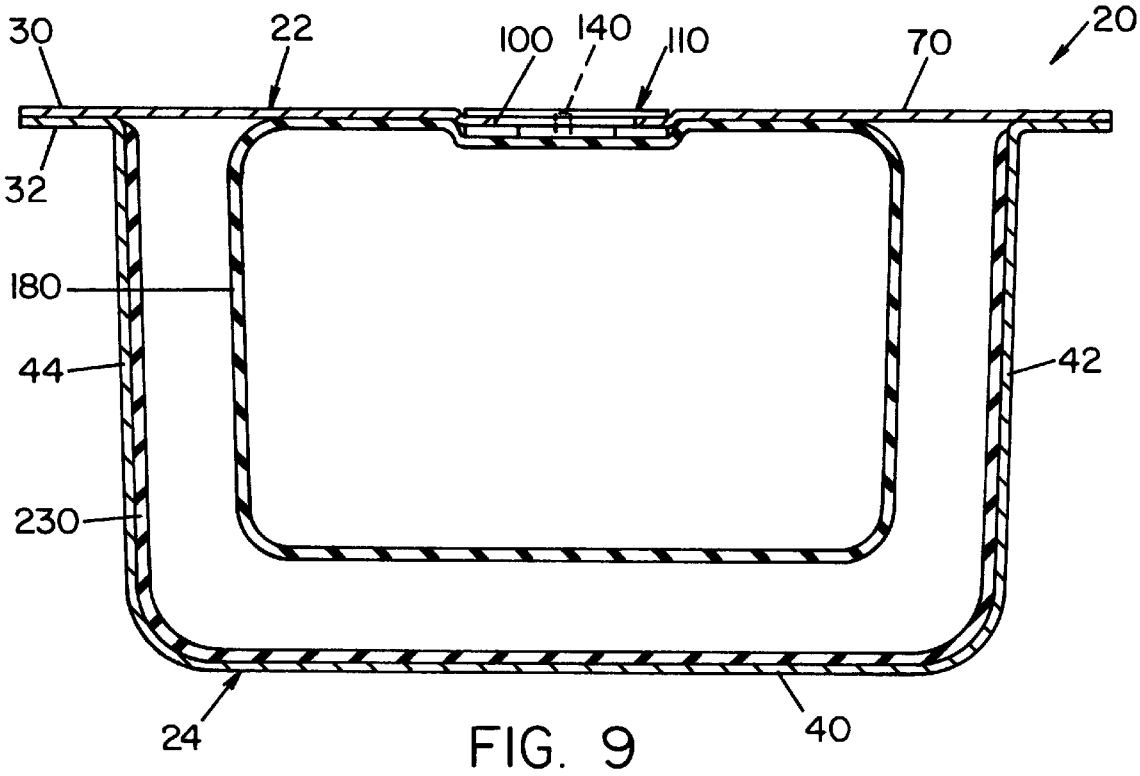
FIG. 9 is a cross-sectional view of still a further embodiment of the float drum illustrating a sealant on the interior surface of the float drum.
Figure 9A:
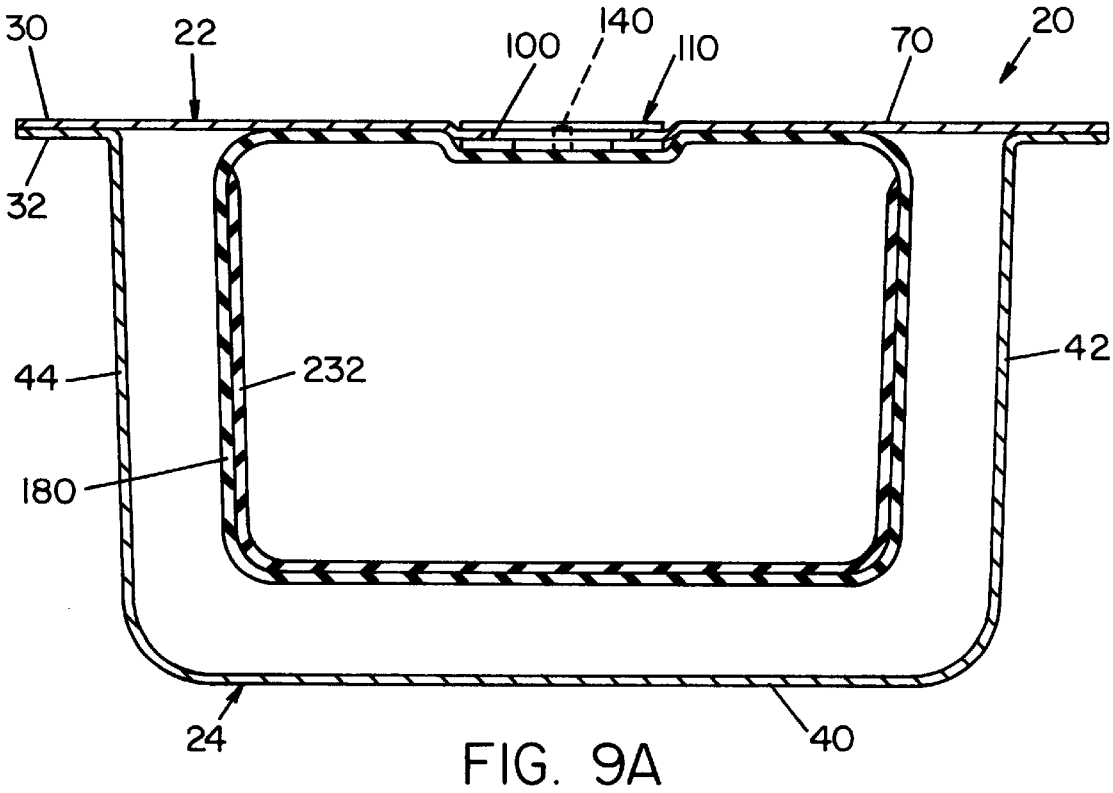
FIG. 9A is a cross-sectional view of yet a further embodiment of the float drum illustrating a sealant on the interior surface of the inflatable material in the interior of the float drum.

Referring now to FIGS. 9 and 9A, a modification of the float drum in FIG. 6A is illustrated. In FIG. 9, the interior surfaces of bottom portion 24 includes a self sealing material 230. The self sealing material is designed to plug a leak or rupture that forms in the bottom portion. In FIG. 9A, the inflatable material includes a self sealing material 232 on the inner surface of the inflatable material. The self sealing material is designed to plug a leak or rupture in the inflatable material. As can be appreciated, the float drum can be designed to include a self sealing material in the inflatable material and on the interior of the bottom portion of the float drum. The self sealing material can be incorporated in any of the float drum designs that are illustrated in FIGS. 1–13 to plug a leak or rupture in the float drum and/or one or more components in the float drum.

Figure 7:
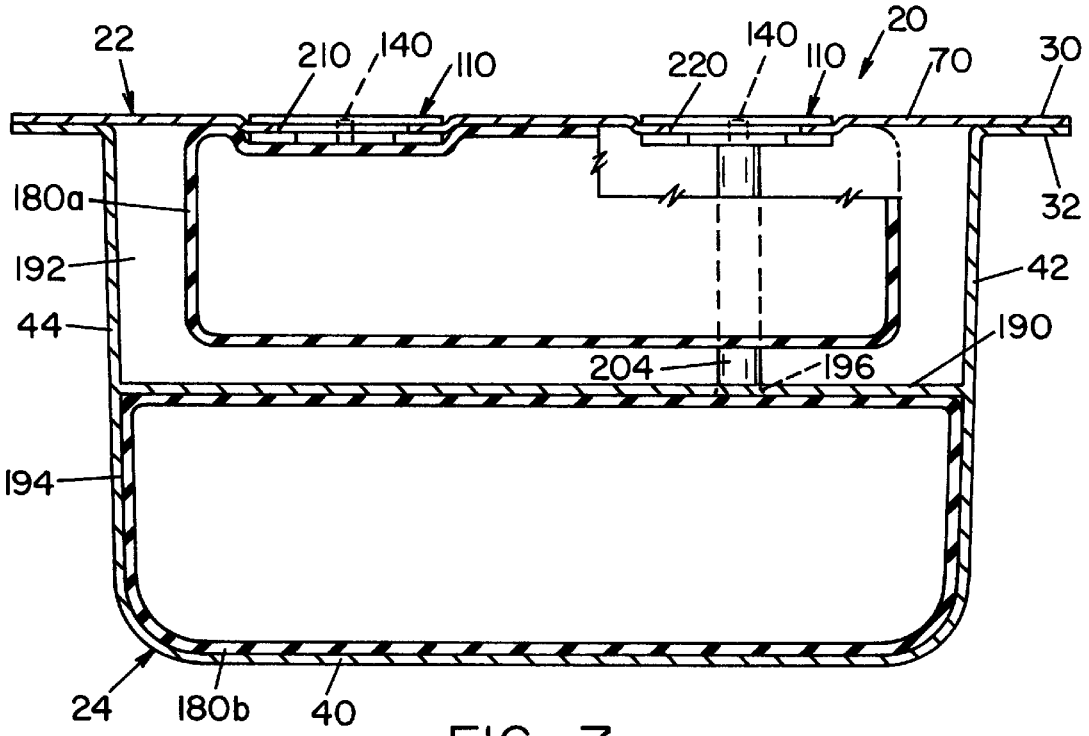
FIG. 7 is a cross-sectional view of still yet another embodiment of the float drum illustrating a two compartment interior having an inflatable material positioned in each compartment.

Referring now to FIG. 7, another embodiment of the float drum is disclosed. The float drum is shown as a two piece unit; however, the float drum can be a one piece blow molded drum. The interior of the float drum is divided into two compartments 192, 194 by a shelf 190 that extends between the interior of walls 42, 44, 46 and 48. Shelf 190 is preferably made of the same material as the top and bottom portion; however, the shelf can be made of a different material. Preferably, shelf 190 divides the interior of the float drum into two substantially fluid tight compartments; however, the two compartments can be form to be in fluid communication with one another. The two compartments have a generally equal volume; however, the shelf can be positioned to form one compartment having a volume that is substantially larger than the other compartment. The shelf is also shown as being positioned substantially parallel to top wall 70 and bottom wall 40; however, the shelf can be positioned nonparallel to the top and bottom walls. As shown in FIG. 7, an inflatable material is positioned in each compartment. The inflatable material 180*a* in the top compartment 192 is illustrated as being spaced from the side walls and shelf 190. The inflatable material 180*b* in the bottom compartment 194 is illustrated as being in contact with substantially all the interior surfaces of the bottom compartment. As can be appreciated, the arrangement of the inflatable materials 180*a*, 180*b* in the compartments can be reversed, or both designed so as minimize contact with the interior surfaces of the compartments, or both designed to maximize contact with the interior surfaces of the compartments. Shelf 190 includes an opening 196 to allow a fluid tube 204 to pass through the shelf and into inflatable material 180*b*. Fluid tube 204 is sealed in opening 196 when compartments 192, 194 are designed of be substantially sealed from each other. The top wall 70 is disclosed as including two openings 210, 220. Each of the two openings and components therein are designed similarly to the opening shown in FIG. 5. Opening 210 provides access to inflatable material 180*a* to inflate and/or deflate the inflatable material and/or service or replace the inflatable material. Opening 220 forms a fluid communication with fluid tube 204 to enable the inflation and/or deflation of inflatable material 180*b*. Opening 196 and any sealing structure about the opening can be designed such that inflatable material 194 can be access for repair or replacement. As can be appreciated, compartments 192, 194 may be empty or contain a floatation material. In one alternate embodiment, one compartment includes and inflatable material and the other compartment is empty or contains a fluid and/or solid matter.

In another alternate embodiment, one compartment includes an inflatable material and the other compartment includes a floatation material. In still another alternate embodiment, one compartment includes a flotation material and the other compartment is empty or contains a fluid and/or solid material. In a further alternative embodiment, a third opening is provided to allow an operator to add and/or remove fluids from the area in the interior of the float drum that is outside the inflatable material(s). The opening can be used to pressurize the float drum to check the integrity of the float drum, add inert fluids and/or to add or remove dense fluids from the float drum to control or regulate the buoyancy of the float drum. In still a further embodiment, the float drum includes a single opening that allows controlled access to a plurality of compartment and/or components in the float drum.

Referring now to FIG. 8, still another embodiment of the float drum is illustrated. The interior of the float drum includes an inner skin 240 which forms two compartments 250, 252 in the interior of the float drum. The float drum is shown as a two piece unit; however, the float drum can be a one piece blow molded drum. Inner skin 240 is preferably made of the same material as the top and bottom portion; however, the inner skin can be made of a different material. Preferably, inner skin 240 divides the interior of the float drum into two substantially fluid tight compartments; however, the two compartments can be form to be in fluid communication with one another. The inner skin is positioned adjacent to the side and end walls of the bottom portion. The inner skin includes a plurality of notches 242 to maintain the spacing of inner skin 240 from the side, end and bottom walls of the bottom portion. As shown in FIG. 8, an inflatable material is positioned in compartment 250. The inflatable material 180 is illustrated as being spaced from the inner surface of inner skin 240; however, the inflatable material can be designed in contact one or more surfaces of the inner skin. The top wall 70 is disclosed as including two openings 260, 270. Each of the two openings and components therein are designed similarly to the opening shown in FIG. 5. Opening 260 provides access to inflatable material 180 to inflate and/or deflate the inflatable material and/or allow for service or replacement of the inflatable material. Opening 270 forms a fluid communication with compartment 252 to allow the addition and/or removal of fluids in the compartment. FIG. 8 illustrates a dense material 280 partially filling compartment 252. The dense material can include, but is not limited to, a dense liquid, a dense solid material, or the like. The dense material is selected to be substantially inert so as not to cause corrosion in the float drum and/or to inhibit microorganism growth on the material. The dense material is added or removed from compartment 252 to control or regulate the buoyancy of the float drum, and/or change the center of gravity of the float drum to affect the stabilization of the float drum. Opening 270 is sized to allow the desired materials to be added or removed from compartment 252. As can be appreciated, compartment 252 can be absent a dense material and/or include an inert gas. In one alternative embodiment, a third opening is provided to allow an operator to add and/or remove fluids into compartment 250 outside the inflatable material. The opening can be used to pressurize compartment 250 to check the integrity of compartment 250 and/or to add or remove dense fluids into compartment 250 to control or regulate the buoyancy of the float drum. In still a further embodiment, the float drum includes a single opening that allows controlled access to a plurality of compartment and/or components in the float drum.

Figure 12:
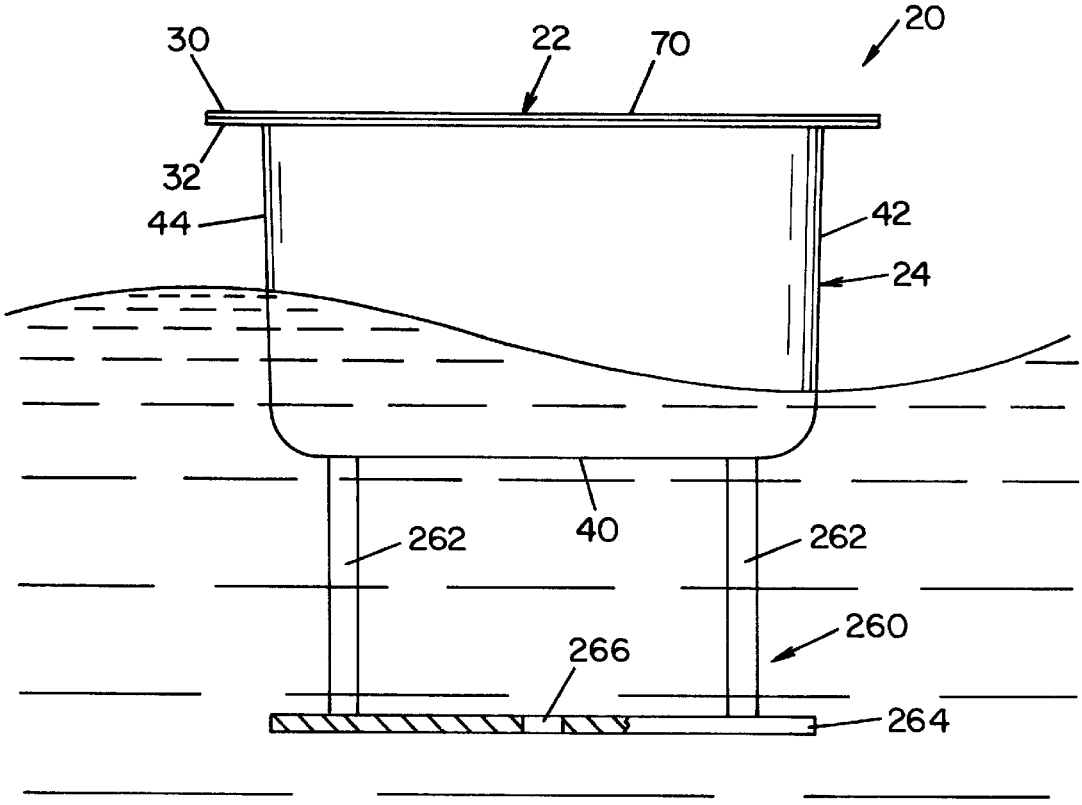
FIG. 12 is a cross-sectional view of another embodiment of the float drum illustrating a float drum stabilizer.
Figure 13:
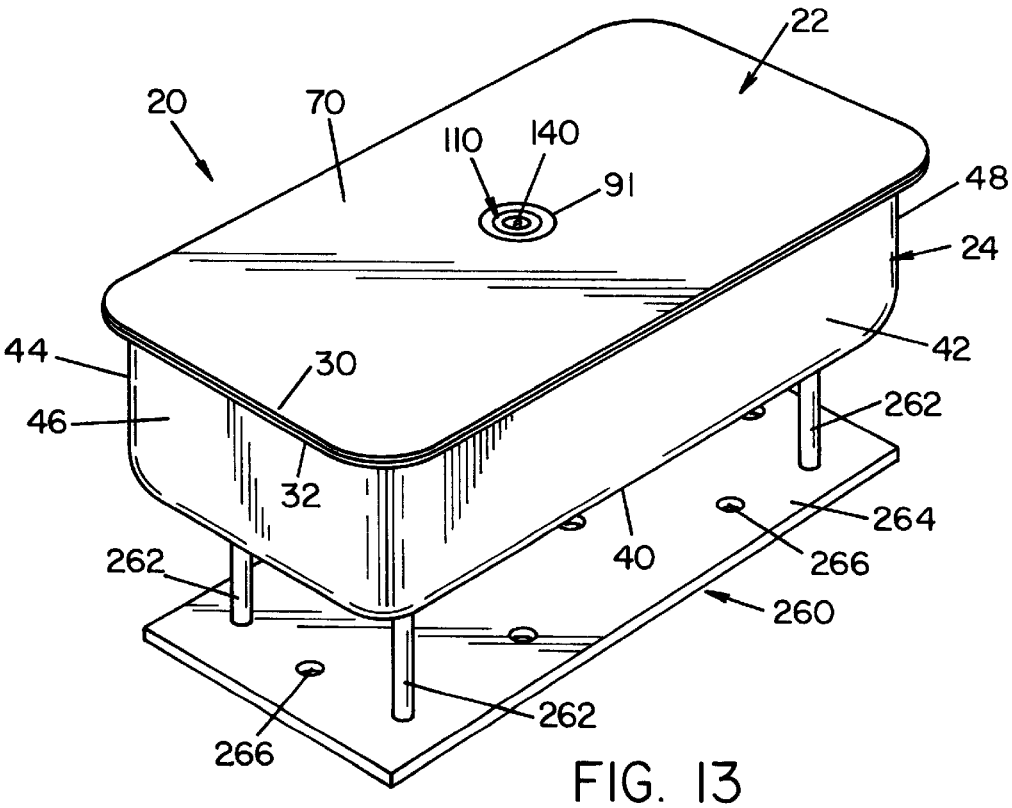
FIG. 13 is a perspective view of the float drum illustrated in FIG. 12.

Referring now to FIGS. 12 and 13, the float drum includes a stabilizer 260 connected to the bottom of bottom wall 40 of bottom portion 24. Stabilizer 260 is shown to have four legs 262 which are connected closely adjacent to the four corners of the bottom wall. The legs can be attached to bottom wall by a variety of ways. The attachers include, but are limited to, bolts, screws, rivets, adhesives, clamps, pins, interlocks, and the like. The legs can alternatively be molded in the bottom wall. The other end of the legs is connected to a flange 264. The flange is positioned so as to be spaced from the bottom wall and lie in a plane that is substantially parallel to the plane of the bottom wall; however the flange can be position nonparallel to the bottom wall. Flange 264 is illustrated as being generally rectangular in shape an being generally the same size as bottom wall 40; however, the flange can have other shapes and sizes. Flange 264 includes one or more openings 266 which allows a fluid to pass though the flange. The openings can be formed in a variety of shapes and/or sizes. As illustrated in FIG. 13, openings 266 are substantially circular in shape. As can be appreciated, more or less legs 262 can be used to connect flange 264 to the base of bottom wall 40. Flange 264 and legs 262 can be formed as a one piece unit. Alternatively, legs 262 are designed to be connected to the flange. Such connections can include, but are not limited to, bolts, screws, rivets, adhesives, clamps, pins, interlocks, and the like. In another alternative, two or more flanges are incorporated in the stabilizer. In such an arrangement, the multiple flanges are preferably positioned substantially parallel to one another. In still another alternative, the flanges are weighted and/or include weights to alter the center of gravity of the float drum toward the base of the float drum. The redistribution of the center of gravity assists in stabilizing the float drum. The combination of the leg(s) and flange(s) function as a ballast to stabilize the float drum. Stabilizer 260 is designed to reduce the movement, i.e. dampen the movement, of the float drum in rough liquid mediums. The reduced movement of the float drum in turn reduces the movement of the dock system thus minimizing damage to the float drum and/or dock system. The openings in the flanges control the degree of stabilization effect of the stabilizer. Flanges having larger and/or more openings allow for greater movement of the float drum in response to waves and/or exposure to wind, and flanges having smaller and/or fewer openings reduce the movement of the float drum in response to waves and/or wind. The degree of desired movement of the float drum will depend on the type of dock system and the type of liquid medium environment. The stabilizer is preferably made of corrosion resistant materials.

The invention has been described with reference to a preferred embodiment and alternates thereof. It is believed that many modifications and alterations to the embodiments disclosed will readily suggest itself to the those skilled in the art upon reading and understanding the detailed description of the invention. It is intended to include all such modifications and alterations insofar as they come within the scope of the present invention.

Having thus defined my invention, I claim:

1. A corrosion-resistant, puncture resistant float drum for supporting marine structures comprising a top wall portion terminating in a circumscribing top flange, a bottom wall portion terminating in a circumscribing a bottom flange, and a fluid opening to provide fluid communication between the exterior and said enclosure of said float drum, said top flange and said bottom flange connected together to define an enclosure having a configuration defined by the interior surfaces of said top and bottom portions, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall portion having a top wall and terminating in a top side flange, said fluid opening being a sealable fluid access to said enclosure to add and remove fluids from said enclosure, including floatation material filling at least partially said enclosure, wherein said floatation material being secured in a substantially rigid position in said enclosure.

2. The float drum as defined in claim 1, wherein said valve allowing fluids in said enclosure to flow through said valve when a pressure inside said enclosure exceeds a predefined pressure.

3. A corrosion-resistant, puncture resistant float drum for supporting marine structures comprising a top wall portion terminating in a circumscribing top flange, a bottom wall portion terminating in a circumscribing a bottom flange, and a fluid opening to provide fluid communication between the exterior and said enclosure of said float drum, said top flange and said bottom flange connected together to define an enclosure having a configuration defined by the interior surfaces of said top and bottom portions, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall portion having a top wall and terminating in a top side flange, said fluid opening being a sealable fluid access to said enclosure to add and remove fluids from said enclosure, wherein said enclosures including a plurality of compartments, at least one of said compartments including an inflatable structure and/or a floatation material.

4. A corrosion-resistant, puncture resistant float drum for supporting marine structures comprising a top wall portion terminating in a circumscribing top flange, a bottom wall portion terminating in a circumscribing a bottom flange, a fluid opening to provide fluid communication between the exterior and said enclosure of said float drum, and including an inflatable and expandable material in said enclosure, said top flange and said bottom flange connected together to define an enclosure having a configuration defined by the interior surfaces of said top and bottom portions, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall portion having a top wall and terminating in a top side flange, said fluid opening being a sealable fluid access to said enclosure to add and remove fluids from said enclosure, said inflatable material altering the buoyancy of that float drum.

5. The float drum as defined in claim 4, including a sealing mechanism to substantially seal together said bottom flange and top flange.

6. The float drum as defined in claim 5, wherein said sealing mechanism includes a gasket positioned between and about the circumference of said bottom flange and said top flange.

7. The float drum as defined in claim 4, wherein said inflatable material in fluid communication with said fluid opening, said opening positioned on said top wall portion.

8. The float drum as defined in claim 5, wherein said inflatable material in fluid communication with said fluid opening, said opening positioned on said top wall portion.

9. The float drum as defined in claim 6, wherein said inflatable material in fluid communication with said fluid opening, said opening positioned on said top wall portion.

10. The float drum as defined in claim 4, wherein said inflatable material partially filling said enclosure.

11. The float drum as defined in claim 7, wherein said inflatable material partially filling said enclosure.

12. The float drum as defined in claim 9, wherein said inflatable material partially filling said enclosure.

13. The float drum as defined in claim 11, wherein said inflatable material being substantially confined to a predetermined region in said inclosure, said predetermined region having a volume which is less than the volume of said enclosure.

14. The float drum as defined in claim 12, wherein said inflatable material being substantially confined to a predetermined region in said inclosure, said predetermined region having a volume which is less than the volume of said enclosure.

15. The float drum as defined in claim 8, wherein said inflatable material being substantially confined to a predetermined region in said inclosure, said predetermined region having a volume which is less than the volume of said enclosure.

16. The float drum as defined in claim 4, where said float drum being a form of a single piece of blow molded plastic.

17. The float drum as defined in claim 4, wherein said float drum being formed of a corrosion-resistant metal.

18. The float drum as defined in claim 15, wherein said float drum being formed of a corrosion-resistant metal.

19. The float drum as defined in claim 14, wherein said float drum being formed of a corrosion-resistant metal.

20. The float drum as defined in claim 18, wherein said metal is selected from the group consisting of stainless steel, titanium, aluminum, a metal coated with a corrosion-resistant alloy, and mixtures thereof.

21. The float drum as defined in claim 4, including floatation material filling at least partially said enclosure.

22. The float drum as defined in claim 19, including floatation material filling at least partially said enclosure.

23. The float drum as defined in claim 15, including floatation material filling at least partially said enclosure.

24. The float drum as defined in claim 20, wherein said floatation material being secured in a substantially rigid position in said enclosure.

25. The float drum as defined in claim 24, wherein said fluid opening including a valve to control pressure in said enclosure.

26. The float drum as defined in claim 7, including a second opening, said fluid opening including a valve to substantially seal fluid in said inflatable material, said second opening including a device to substantially close said second opening.

27. The float drum as defined in claim 25, including a second opening, said fluid opening including a valve to substantially seal fluid in said inflatable material, said second opening including a device to substantially close said second opening.

28. The float drum as defined in claim 22, including a second opening, said fluid opening including a valve to substantially seal fluid in said inflatable material, said second opening including a device to substantially close said second opening.

29. The float drum as defined in claim 26, wherein said device in said second opening including a valve to control fluids into and out of said enclosure.

30. The float drum as defined in claim 26, wherein said top portion includes at least one attachment indicators positioned on said top flange.

31. The float drum as defined in claim 26, wherein said top wall portion including a structural enhancer, said structural enhancer including a structure selected from the group consisting of an indentation, a supporting rib, and combinations thereof.

32. The float drum as defined in claim 26, wherein said bottom wall portion including a structural enhancer, said structural enhancer including a structure selected from the group consisting of an indentation, a supporting rib, and combinations thereof.

33. The float drum as defined in claim 4, including a stabilizer to dampen the movement of said float drum in a liquid medium.

34. The float drum as defined in claim 27, including a stabilizer to dampen the movement of said float drum in a liquid medium.

35. The float drum as defined in claim 26, including a stabilizer to dampen the movement of said float drum in a liquid medium.

36. The float drum as defined in claim 32, wherein said stabilizer being connected to said bottom wall.

37. The float drum as defined in claim 34, wherein said stabilizer being connected to said bottom wall.

38. The float drum as defined in claim 26, wherein said inclosure including a substantially insert gas to inhibit microorganism growth in said enclosure.

39. A corrosion-resistant, puncture resistant float drum for supporting marine structures comprising a top wall portion terminating in a circumscribing top flange, a bottom wall portion terminating in a circumscribing a bottom flange, and a fluid opening to provide fluid communication between the exterior and said enclosure of said float drum, said top flange and said bottom flange connected together to define an enclosure having a configuration defined by the interior surfaces of said top and bottom portions, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall portion having a top wall and terminating in a top side flange, said fluid opening being a sealable fluid access to said enclosure to add and remove fluids from said enclosure, wherein said inclosure including a substantially insert gas to inhibit microorganism growth in said enclosure.

40. A corrosion-resistant, puncture resistant float drum for supporting marine structures comprising a top wall portion terminating in a circumscribing top flange, a bottom wall portion terminating in a circumscribing a bottom flange, and a fluid opening to provide fluid communication between the exterior and said enclosure of said float drum, said top flange and said bottom flange connected together to define an enclosure having a configuration defined by the interior surfaces of said top and bottom portions, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall portion having a top wall and terminating in a top side flange, said fluid opening being a sealable fluid access to said enclosure to add and remove fluids from said enclosure, including a stabilizer to dampen the movement of said float drum in a liquid medium, wherein said inclosure including a substantially insert gas to inhibit microorganism growth in said enclosure.

41. A corrosion-resistant, puncture resistant float drum for supporting marine structures comprising a top wall portion terminating in a circumscribing top flange, a bottom wall portion terminating in a circumscribing a bottom flange, and a fluid opening to provide fluid communication between the exterior and said enclosure of said float drum, said top flange and said bottom flange connected together to define an enclosure having a configuration defined by the interior surfaces of said top and bottom portions, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall portion having a top wall and terminating in a top side flange, said fluid opening being a sealable fluid access to said enclosure to add and remove fluids from said enclosure, wherein said inclosure including a substantially insert gas to inhibit microorganism growth in said enclosure.

42. A corrosion-resistant, puncture resistant float drum for supporting marine structures comprising a top wall portion terminating in a circumscribing top flange, a bottom wall portion terminating in a circumscribing bottom flange, a fluid opening, and a variable buoyancy control device, said top flange and said bottom flange connected together to define an enclosure having a configuration defined by the interior surfaces of said top and bottom portions and including a sealing mechanism to substantially seal together said bottom flange and top flange, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a bottom side flange circumscribing said bottom wall portion and extending away from said bottom wall, said top wall terminating in a top side flange, said fluid opening being a sealable fluid access from the exterior of said float drum to said enclosure to add fluids to and to remove fluids from, said enclosure, said fluid opening having a valve positioned in said opening to control pressure in said enclosure, said variable buoyancy device positioned in said enclosure and varying the buoyancy of said float drum, said float drum substantially formed of a metal selected from the group consisting of stainless steel, titanium, aluminum, a metal coated with a corrosion-resistant alloy, and mixtures thereof.

43. The float drum as defined in claim 42, wherein said sealing mechanism includes a gasket positioned between and about the circumference of said bottom flange and said top flange.

44. The float drum as defined in claim 42, wherein said variable buoyancy control device including an inflatable material in fluid communication with said fluid opening.

45. The float drum as defined in claim 43, wherein said variable buoyancy control device including an inflatable material in fluid communication with said fluid opening.

46. The float drum as defined in claim 42, wherein said variable buoyancy control device including a predefined compartment in said enclosure in fluid communication with said fluid opening, said predefined compartment having a volume which is less than the volume of said enclosure.

47. The float drum as defined in claim 44, wherein said variable buoyancy control device including a predefined compartment in said enclosure in fluid communication with said fluid opening, said predefined compartment having a volume which is less than the volume of said enclosure.

48. The float drum as defined in claim 45, wherein said variable buoyancy control device including a predefined compartment in said enclosure in fluid communication with said fluid opening, said predefined compartment having a volume which is less than the volume of said enclosure.

49. The float drum as defined in claim 42, wherein said variable buoyancy control device includes a predefined compartment in said enclosure for at least partially receiving a liquid material.

50. The float drum as defined in claim 46, wherein said variable buoyancy control device includes a predefined compartment in said enclosure for at least partially receiving a liquid material.

51. The float drum as defined in claim 48, wherein said variable buoyancy control device includes a predefined compartment in said enclosure for at least partially receiving a liquid material.

52. The float drum as defined in claim 49, wherein said predefined compartment in fluid communication with an exterior of said float drum.

53. The float drum as defined in claim 42, wherein said enclosure including a floatation material.

54. The float drum as defined in claim 47, wherein said enclosure including a floatation material.

55. The float drum as defined in claim 51, wherein said enclosure including a floatation material.

56. The float drum as defined in claim 53, wherein said enclosure substantially filled with said floatation material.

57. The float drum as defined in claim 53, wherein said floatation material and being secured in a substantially rigid position in said enclosure.

58. The float drum as defined in claim 54, wherein said floatation material and being secured in a substantially rigid position in said enclosure.

59. The float drum as defined in claim 55, wherein said floatation material and being secured in a substantially rigid position in said enclosure.

60. The float drum as defined in claim 42, wherein said fluid opening positioned on said top wall portion.

61. The float drum as defined in claim 59, wherein said fluid opening positioned on said top wall portion.

62. The float drum as defined in claim 42, said fluid opening including a valve to control pressure in said enclosure.

63. The float drum as defined in claim 58, said fluid opening including a valve to control pressure in said enclosure and/or inflatable material.

64. The float drum as defined in claim 61, said fluid opening including a valve to control pressure in said enclosure and/or inflatable material.

65. The float drum as defined in claim 64, wherein said top wall portion including a structural enhancer, said structural enhancer including a structure selected from the group consisting of an indentation, a supporting rib, and combinations thereof.

66. The float drum as defined in claim 65, wherein said bottom wall portion including a structural enhancer, said structural enhancer including a structure selected from the group consisting of an indentation, a supporting rib, and combinations thereof.

67. The float drum as defined in claim 42, including a stabilizer to dampen the movement of said float drum in a liquid medium.

68. The float drum as defined in claim 66, including a stabilizer to dampen the movement of said float drum in a liquid medium.

69. The float drum as defined in claim 42, wherein said enclosures including a plurality of compartments, at least one of said compartments including an inflatable structure and/or a floatation material.

70. The float drum as defined in claim 63, wherein said enclosures including a plurality of compartments, at least one of said compartments including an inflatable structure and/or a floatation material.

71. The float drum as defined in claim 68, wherein said enclosures including a plurality of compartments, at least one of said compartments including an inflatable structure and/or a floatation material.

72. The float drum as defined in claim 42, wherein said inclosure including a substantially insert gas to inhibit microorganism growth in said enclosure.

73. The float drum as defined in claim 70, wherein said inclosure including a substantially insert gas to inhibit microorganism growth in said enclosure.

74. The float drum as defined in claim 71, wherein said inclosure including a substantially insert gas to inhibit microorganism growth in said enclosure.

75. The float drum as defined in claim 42, including a self sealing sealant on the interior surface of said enclosure.

76. The float drum as defined in claim 44, including a self sealing sealant on said inflatable material.

77. A corrosion-resistant, puncture resistant float drum for supporting marine structures comprising a top wall portion and a bottom wall portion, said top wall portion and said bottom wall portion connected together to define an enclosure having a configuration defined by the interior surfaces of said top and bottom wall portions, said bottom wall portion having a bottom wall and at least one side wall extending from said bottom wall, said enclosure divided into a plurality of compartments, at least one of said compartments including a buoyancy control material, at least one of said compartments in fluid communication with a fluid opening in said top wall portion or said bottom wall portion.

78. A float drum as defined in claim 77, wherein one of said compartments is at least partially spaced from said bottom wall portion.

79. A float drum as defined in claim 77, wherein at least one of said compartments having at least one compartment side wall, at least a portion of said compartment side walls spaced from the interior surfaces of said bottom wall portion.

80. A float drum as defined in claim 78, wherein at least one of said compartments having at least one compartment side wall, at least a portion of said compartment side walls spaced from the interior surfaces of said bottom wall portion.

81. A float drum as defined in claim 79, wherein at least one said compartments substantially fluid tight from at least one adjacent compartment.

82. A float drum as defined in claim 81, wherein at least one said compartments substantially fluid tight from at least one adjacent compartment.

83. A float drum as defined in claim 77, wherein said buoyancy control material is selected from the group consisting of gas, liquid, flotation material, and combinations thereof.

84. A float drum as defined in claim 82, wherein said buoyancy control material is selected from the group consisting of gas, liquid, flotation material, and combinations thereof.

85. The float drum as defined in claim 77, including floatation material filling at least partially at least one of said compartments.

86. The float drum as defined in claim 84, including floatation material filling at least partially at least one of said compartments.

87. The float drum as defined in claim 77, including a stabilizer to dampen the movement of said float drum in a liquid medium.

88. The float drum as defined in claim 86, including a stabilizer to dampen the movement of said float drum in a liquid medium.

89. The float drum as defined in claim 88, including a self sealing sealant on the surface of at least one of said compartments.

90. The float drum as defined in claim 77, where said float drum being a form of a single piece of blow molded plastic.

91. The float drum as defined in claim 77, wherein said float drum being formed of a corrosion-resistant metal.

92. The float drum as defined in claim 77, wherein said fluid opening having a valve positioned in said opening to control pressure in said compartment.

93. The float drum as defined in claim 92, wherein said valve allowing fluids in said compartment to flow through said valve when a pressure inside said compartment exceeds a predefined pressure.

94. The float drum as defined in claim 92, wherein said valve substantially sealing fluids in said compartment.

95. A corrosion-resistant, puncture resistant float drum for supporting marine structures comprising a top wall portion terminating in a flange and a bottom wall portion terminating in a flange, said top wall portion and said bottom wall portion connected together at said flange to define an enclosure having a configuration defined by the interior surfaces of said top and bottom wall portions, said bottom wall portion having a bottom wall, a pair of side walls extending from the said bottom wall, a pair of end walls extending from said bottom wall, each side and end wall extending away from said bottom wall, said enclosure divided into a plurality of compartments, at least one of said compartments including a buoyancy control material, including a self sealing sealant on the surface of at least one of said compartments.

96. A corrosion-resistant, puncture resistant float drum for supporting marine structures comprising a top wall portion terminating in a flange and a bottom wall portion terminating in a flange, said top wall portion and said bottom wall portion connected together at said flange to define an enclosure having a configuration defined by the interior surfaces of said top and bottom wall portions, said bottom wall portion having a bottom wall, a pair of side walls extending from the said bottom wall, a pair of end walls extending from said bottom wall, each side and end wall extending away from said bottom wall, said enclosure divided into a plurality of compartments, at least one of said compartments including a buoyancy control material, including a variable buoyancy control device in at least one of said compartments.

97. The float drum as defined in claim 96, including a variable buoyancy control device in at least one of said compartments.

98. The float drum as defined in claim 97, where said float drum being a form of a single piece of blow molded plastic.

99. The float drum as defined in claim 97, wherein said float drum being formed of a corrosion-resistant metal.

100. The float drum as defined in claim 99, wherein said fluid opening having a valve positioned in said opening to control pressure in said compartment.

101. The float drum as defined in claim 100, wherein said valve allowing fluids in said compartment to flow through said valve when a pressure inside said compartment exceeds a predefined pressure.

102. The float drum as defined in claim 100, wherein said valve substantially sealing fluids in said compartment.

103. The float drum as defined in claim 101, wherein said valve substantially sealing fluids in said compartment.

* * * * *